US005347292A

United States Patent [19]

Ge et al.

[11] Patent Number: 5,347,292

[45] Date of Patent: Sep. 13, 1994

[54] SUPER HIGH RESOLUTION COLD CATHODE FLUORESCENT DISPLAY

[75] Inventors: Shichao Ge, Santa Clara; Victor Lam, Saratoga, both of Calif.

[73] Assignee: PanoCorp Display Systems, Santa Clara, Calif.

[21] Appl. No.: 967,976

[22] Filed: Oct. 28, 1992

[51] Int. Cl.[5] ..... G09G 3/24; H01J 1/02

[52] U.S. Cl. ..... 345/74; 313/309; 315/169.1

[58] Field of Search ..... 340/758, 771, 772, 781; 313/306, 309, 310, 312, 496, 497, 514; 345/74, 75, 66, 67; 315/169.1

[56] References Cited

U.S. PATENT DOCUMENTS

| | | | |
|---|---|---|---|
| 3,855,499 | 12/1974 | Yamada et al. . | |
| 4,422,731 | 12/1983 | Drouget et al. . | |
| 4,451,759 | 5/1984 | Heynisch . | |
| 4,721,885 | 1/1988 | Brodie | 313/309 |
| 4,857,161 | 8/1989 | Borel et al. . | |
| 4,857,799 | 8/1989 | Spindt et al. . | |
| 4,908,539 | 3/1990 | Meyer . | |
| 4,923,421 | 5/1990 | Brodie et al. . | |
| 4,940,916 | 7/1990 | Borel et al. . | |
| 4,973,888 | 11/1990 | Morimoto et al. . | |
| 5,015,912 | 5/1991 | Spindt et al. . | |
| 5,053,673 | 10/1991 | Tomii et al. | 313/309 |
| 5,063,323 | 11/1991 | Longo et al. | 313/310 |
| 5,063,327 | 11/1991 | Brodie et al. . | |
| 5,191,259 | 3/1993 | Hayashi et al. | 313/497 |
| 5,202,609 | 4/1993 | Tomii et al. | 313/497 |

FOREIGN PATENT DOCUMENTS

| | | |
|---|---|---|
| 0461657 | 12/1991 | European Pat. Off. . |
| 3276542 | 12/1991 | Japan . |
| WO8505491 | 12/1985 | PCT Int'l Appl. . |
| WO9105363 | 4/1991 | PCT Int'l Appl. . |
| WO9200600 | 1/1992 | PCT Int'l Appl. . |

*Primary Examiner*—Richard Hjerpe
*Assistant Examiner*—Steven J. Saras
*Attorney, Agent, or Firm*—Majestic, Parsons, Siebert & Hsue

[57] ABSTRACT

A super high resolution cold cathode fluorescent display (CFD) utilizes an anode with cathodoluminescent means, a cathode with field emission cathode group array, a glass like spacer plate structure providing an array of funnel-shaped channels. Each channel has a narrow aperture which serves as a pin hole for passage of electrons between the cathodes and anode. The display uses a circuit for generating a strong electric field between the anode and cathode in the array of channels to take advantage of the pin hole imaging effect to produce high resolution, full color images for the display.

56 Claims, 19 Drawing Sheets

SUPER HIGH RESOLUTION COLD CATHODE FLUORESCENT DISPLAY

CROSS-REFERENCE TO RELATED PATENT DOCUMENTS

This patent application is related to disclosure document no. 315943 received at the U.S. Patent and Trademark Office Mailroom on Aug. 24, 1992.

BACKGROUND OF THE INVENTION

The present invention relates to flat panel displays of the field emission cathode type and, in particular, to the use of a spacer between a cathode and an anode to take advantage of the pin hole imaging effect and an electric field to produce high resolution full color image display. In the preferred embodiment, the spacer is made of a glass-ceramic material.

The cathode ray tube (CRT) technology, with its many attractive attributes such as high brightness, good color quality, high resolution, long operating life time, is still the main stream display technology nowadays. It is its bulk that overshadows a lot of its merits and encourages the emerging flat panel technologies to challenge its place. Through the last twenty years, various types of flat panel technologies have emerged but have succeeded only in making a dent on the vast display market by creating a small form factor display panel for the portable computer industry. The huge consumer television (TV) market, which is emerging towards high definition television (HDTV) format, is still unchallenged by the current available flat panel technologies, such as: liquid crystal display (LCD); electroluminescent display (EL); plasma display panel (PDP); vacuum fluorescent display (VFD); field emission display (FED) and light emitting diode (LED).

The problem of these current flat panel technologies is that they in principle only have a few, but not all of the above mentioned attributes that the CRT technology inherently enjoys. The LCD does not emit light. The PDP cannot generate quality color efficiently and is in association with very complicated drive circuitry. The EL and LED are deficient in blue color. The VFD is deficient in color. The FED in principle should have all the good attributes but lacks a structure to embrace them. In order to break these barriers, some approaches have resorted to brute force by spending billions of dollar on a particular flat panel technology. The 10 inch active matrix liquid crystal display (AMLCD), a color display, is a result of such an effort, but one can also tell from the difficulty of this effort that a 40 inch AMLCD will be extremely difficult to achieve.

In the FED, its cathode is based on the field emission cold cathode principle, as proposed by Spindt in 1968. In this design, the anode is made based on the common CRT anode principle, such as using an electrical conductor coated with phosphor material emitting light in response to the bombardment of electrons from the cathode. In principle, this type of device has the potential of providing many nice features, such as high emission efficiency, high and stable emission current, good color quality, high resolution, small form factor and simple control mechanism. The main problems that it is facing today is lacking a structure which can provide:

(1) uniform spacing between Cathode and Anode;

(2) adequate spacing to allow sufficient anode voltage to be applied in order to realize the good quality of the CRT phosphor;

(3) means to guarantee minimum cross-talk between phosphor dots to achieve high resolution;

(4) means to provide strong support between anode and cathode so that both conditions as mentioned in above items 1, 2 and 3 can be met and thus a thin and large display device can be realized; and (5) easy to manufacture.

Many structures have been proposed by various people before in order to satisfy these criteria. None of them have succeeded completely. These structures can be basically grouped into the following three categories:

1. Polyimide Type Spacer Structure

The U.S. Pat. Nos. 5,063,327, 4,923,421 and 4,857,161, are typical in this approach. It uses a supporting mechanism made from polyimide spacers or pillars using techniques commonly known in the integrated circuit industry, to separate the emitting surface and the display face of the flat panel display.

2. Rigid Elongated Thin and Pointed Spacer Structure

The U.S. Pat. No. 4,857,799, and 5,015,912 illustrate this type of display. The supporting mechanism is composed of elongated, thin and pointed parallel spacer plates integrally connected between the face plate and back plate, to be interspersed between adjacent rows of pixels on the anode.

3. Small Discrete Type Device with Limited Peripheral Wall Support Structure

The U.S. Pat. No. 3,855,499 is a typical example of this type of display where the whole device relies on the peripheral wall support to create a small vacuum environment for the display device to function.

In the three types of displays described above, the first type, while providing a structure that satisfies the first, third and fifth but fails to satisfies the second and fourth of the above mentioned criteria. In other words, for the first type of displays, the thin pillars used as the support between the face plate and back plate can only be made to allow a very small spacing between these two plates. Within this spacing, only low anode voltage can be used and thus only bluish green ZnO:Zn type low voltage phosphor of the VFD type can be used. Phosphors of other color operating in this low voltage will exhibit low efficiency, low brightness and short life time. This technique is also incapable of providing larger spacing between these two plates.

The design in the second type, while providing a structure that satisfies the second (i.e. larger spacing), fails somewhat in satisfying the first, third, fourth and fifth of the above mentioned criteria.

The third type, while it can provide character or graphic generator type of display application, is only applicable to a limited small size device of a few inches only.

The present invention intends to address these problems by introducing a new shield plate structure, whereof an electric field will be applied between the anode and cathodes using the pin hole image effect to create a new kind of FED, such that all of the above mentioned criteria can be satisfied to produce a high resolution, high brightness, high efficiency, full color flat panel display device with very thin profile and very simple structure.

SUMMARY OF THE INVENTION

In a pin hole camera, light originating from a real life environment is passed through a small pin hole to impinge upon a light sensitive medium upon emerging from the pin hole. The pin hole is small relative to the size of the picture to be taken, so that light originating from a point in the environment will impinge upon only a very small area of the light sensitive medium, thus producing a distinct image of such point in the environment on the light sensitive medium. In this manner, each point in the environment may be regarded as a point light source whose distinct image is reproduced by the light sensitive medium through the pin hole camera.

Since the pin hole is small, the distinct image of each point source in the environment does not overlap significantly with the images of other point sources in the environment. The smaller the size of the pin hole relative to the picture to be taken, the less overlap there will be between the images of different light point sources from the environment, even though they may be adjacent to one another.

This invention is based on the recognition that, by using a principle analogous to that of the above-described pin hole camera, a new kind of FED can be constructed to produce a high resolution, high brightness, and high efficiency full color flat panel display device. In this invention, a new shield structure is proposed where the shield defines one or more apertures or pin holes therein where the shield is placed between the face and back plates of the display device. Electrons generated by a point source cathode on or near the back plate will pass through an aperture and impinge upon a small area of a luminescent means on or near the anode. In response to the bombardment of such electrons, the small portion of the luminescent means will emit light to form an image that is displayed, where such image displayed is analogous to the image in the pin hole camera, and will be referred to below as the image of the point source cathode from which the electrons originated. In the preferred embodiment of the invention, an electonic lens electrode is formed around each aperture or pin hole and appropriate electrical potentials applied thereto to pull electrons passing through the aperture or pin hole and to influence the passage of the electrons.

Similar to the operation of a pin hole camera, if the aperture in the shield is small, the image produced on a portion of the luminescent means due to the bombardment of electrons originating from a point cathode on or near the back plate will not substantially overlap the image produced by the luminescent means due to the electrons originating from a different point source, even though the two point sources are close together. In other words, it is possible to produce a sharp image at high resolution with much reduced crosstalk between adjacent pixels.

One aspect of this invention is directed towards a display apparatus comprising a housing defining a chamber therein, said housing having a face plate and a back plate, an anode placed on or near the face plate, and luminescent means, placed on or near the anode, that emits light in response to bombardment of electrons. The luminescent means has two portions defining at least a first and a second pixel dot. The apparatus further includes a plurality of individually addressable, controllable electron point source cathodes arranged in at least a first and a second group on or near the back plate, and a circuit for applying electrical potentials to the anode and groups of cathodes for causing the cathodes to emit electrons and causing the electrons to travel to the pixel dots, and for direct matrix addressing and electron emission control of the cathodes. The apparatus also includes a shield between the face and back plates. The shield defines at least one aperture therein located between the groups of cathodes and the pixel dots. The shield substantially shields the pixel dots from electrons passing between the cathodes and the pixel dots except for electrons passing through the aperture. The aperture is of such dimensions that electrons emitted by the first group of cathodes and passing through the aperture will travel to substantially only the first pixel dot, and that electrons emitted by the second group of cathodes and passing through the aperture will travel to substantially only the second pixel dot, thereby reducing crosstalk between pixel dots. In the preferred embodiment, an electronic lens electrode is formed around each aperture to attract electrons from the point sources to pass through each aperture.

Since it is possible to individually control the quantity of electrons emitted by one point source cathode so that it is different from the quantity of electrons emitted by an adjacent point source cathode, the image of one point source on the luminescent means can be of the desired brightness relative to the image of an adjacent point source cathode so that high resolution multiple shades images can be achieved.

In the preferred embodiment, the shield defines channels therein, each channel being in the shape of two funnel-shaped holes, where the wide ends of the two holes are closer to the face and back plates than the narrow ends, and where the narrow ends are aligned with each other forming the aperture. There is an electronic lens electrode surrounding each aperture or pin hole. Preferably, the funnel-shaped holes are wedge-shaped. The size of the aperture or pin hole (aperture and pin hole being used interchangeably herein in this application) may be varied, and the depth of its two corresponding wedge-shaped holes and the size of its two wide ends toward the anode and cathode may be varied to focus the electrons passing through the aperture to the desired pixel dots. The pin hole or aperture preferably has distinct size and shape of its own to help focus electrons emitted from a point source cathode group, which is formed by multiple adjacent point source cathodes and situated on one side of the pin hole, to travel under the influence of the anode, through the small pin hole, and hit the phosphor material of the anode situated on the other side of the pin hole, causing it to emit light and thus producing a distinct image of the said point source cathode group on the anode.

In one embodiment, the shield is formed by a spacer plate structure which provides support to the face and back plates. The new spacer plate structure is preferably made by using photo-chemical process to produce fine geometries on a thin and flat UV-sensitive glass type spacer plate with tight control on three dimensional aspects. The resultant spacer plate exhibits glass or glass-ceramic like physical properties and can be mass produced in an economical way. The spacer plate structure can be coated with high resistance material such that localized trapped electrons can be removed from the said mechanical passage to provide a charge free environment for the electrons to pass by.

In the preferred embodiment, the apparatus of this invention comprises a transparent face plate, one or more pieces of spacer plate, and a back plate to form a vacuum tight housing, providing an airtight environment for a display means by cathodoluminescence excited by field emission electrons. An anode is formed on the inner surface of the face plate by forming a transparent conductive coating of ITO or SnO2. An array of phosphor dots, arranged in a configuration of, either a single color format for monochromic, or a mixed red, green and blue (R.G.B.) color pixel group format for full color, is formed on top of the conductive coating to provide display means for the display device. Field emission cathode devices are formed on the inner surface of the back plate in such a way that the field emission cathodes are further divided into numerous field emission cathode groups, each having its unique gate electrode and base electrode to control the field emission cathodes within each group as a whole, and forming a field emission cathode group array with the groups having similar size and shape corresponding to the phosphor dots in the array of phosphor dots formed on the anode. In this embodiment, the exact size and shape of the field emission cathode groups depend on the final dimension of the mechanical channel or passage defined by the pin hole or aperture and the two of its corresponding wedge-shaped holes. The said gate and base electrodes can be used for matrix addressing means for the display device. Two glass-ceramic type spacer plates each having an array of rectangular wedge-shaped holes, form a composite spacer plate by stacking up on each other in such a way that the larger rectangular holes are facing outside while the smaller rectangular holes are aligned and touching each other, forming a small rectangular shape pin hole on a plane in this embodiment. The small rectangular pin hole together with its two corresponding rectangular wedge-shaped hole defines the said mechanical passage. A conductive coating is formed on top of one spacer plate on the particular surface associated with the smaller rectangular holes without blocking those holes to serve as an electronic lens electrode for the composite spacer plate. This electronic lens electrode can also be used as means for matrix addressing of the display device. This composite spacer plate is placed between the face and back plates with each of the two surfaces of the composite spacer plate making full contact with the face and back plates to provide uniform support for the air-tight vacuum housing. Furthermore, each rectangular aperture or pin hole within this composite spacer plate, will have one of its openings defining either one or more phosphor dots on the anode, while the other opening defining one or more field emission cathode groups on the cathode, whereof the number and shape of the field emission cathode group on the cathode side corresponds to that of the phosphor dot, or dots on the anode side. Cross-talk can thus be restricted to each phosphor dot or dots only within each hole for a high resolution display.

In the preferred embodiment, the spacer plate is made of glass-ceramic type of material, and its strength can be further reinforced by making the four sides of each hole a wedge-shaped surface converging towards the center to form a smaller rectangular pin hole. This spacer plate structure can provide substantial spacing between the anode and cathode, so that a substantial anode voltage can be used in this structure to enable the use of regular CRT phosphors in order for this structure to enjoy all the good attributes derived from these phosphors. The face plate, the composite spacer plate, and the back plate can be aligned very easily with alignment pins through pre-registered alignment holes formed on the peripheral of each plate. Such a housing will enable the use of very thin face plate in the range of 0.5 mm to 5.0 mm for a large range of display devices sizing form a few inches to over fifty inches diagonal and still able to withstand the atmospheric pressure exerts on its surface.

The holes within the composite spacer plate can be connected together in one embodiment, either by forming small grooves through photo-chemical process on the spacer plate surface, or by forming small grooves on the back plate while making the field emission cathode group array on the back plate. Other methods such as using glass frit or polyimide to form small raised pillars on the back plate, or the surface of one of the spacer plate, will also serve the same purpose.

In the preferred embodiment, since the whole cathode is actually an electron point source array composed of numerous field emission cathode groups, and each of these electron point sources can project its images through the pin hole to the anode, the size and spacing of each of these electron point sources determine the resolution of the display. We all know that the field emission cathode device is very small and efficient. The electron point sources composed of these tiny devices are also very small and efficient. That is how a high resolution, high brightness flat panel color display can be produced under the present invention.

BRIEF DESCRIPTION OF THE DRAWINGS

The present invention will be better understood from reading the following description of the embodiments, with reference to the attached drawings.

DETAILED DESCRIPTION OF THE PREFERRED EMBODIMENT

Figure 1:
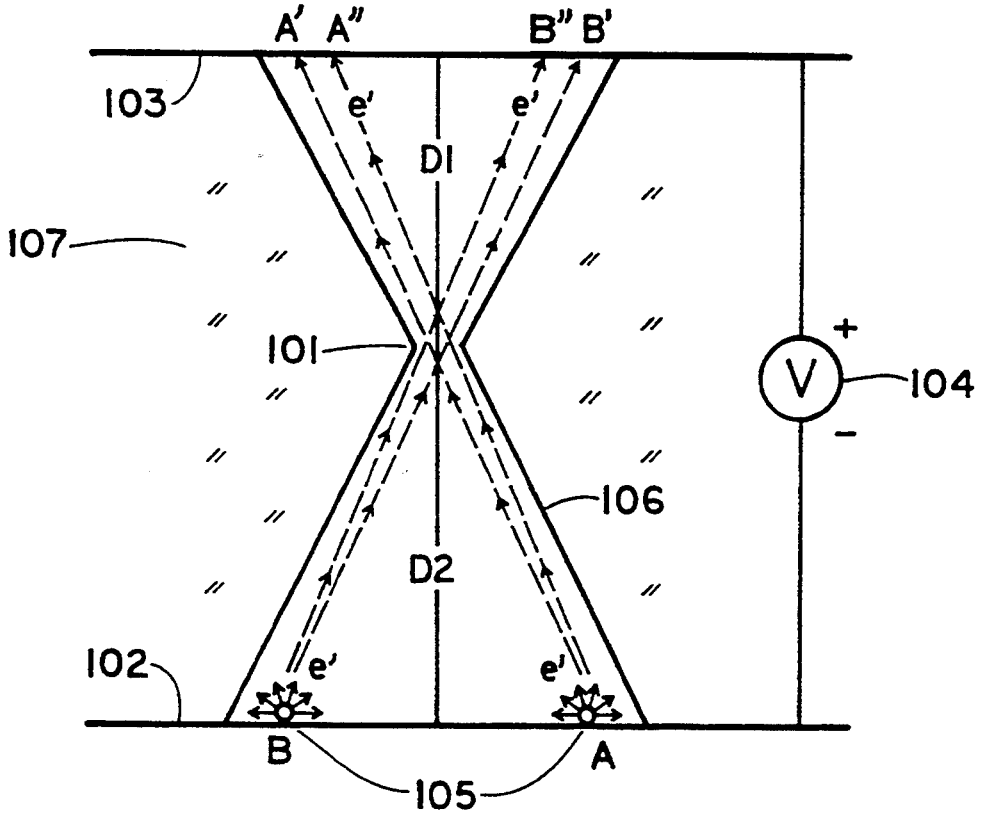
FIG. 1 is a simplified schematic view of a display device using a small aperture or pin hole and an electric field for directing electrons through the pin hole originating from adjacent cathode sources in order to create essentially non-overlapping image of the cathode sources to illustrate the invention.
Figure 2:
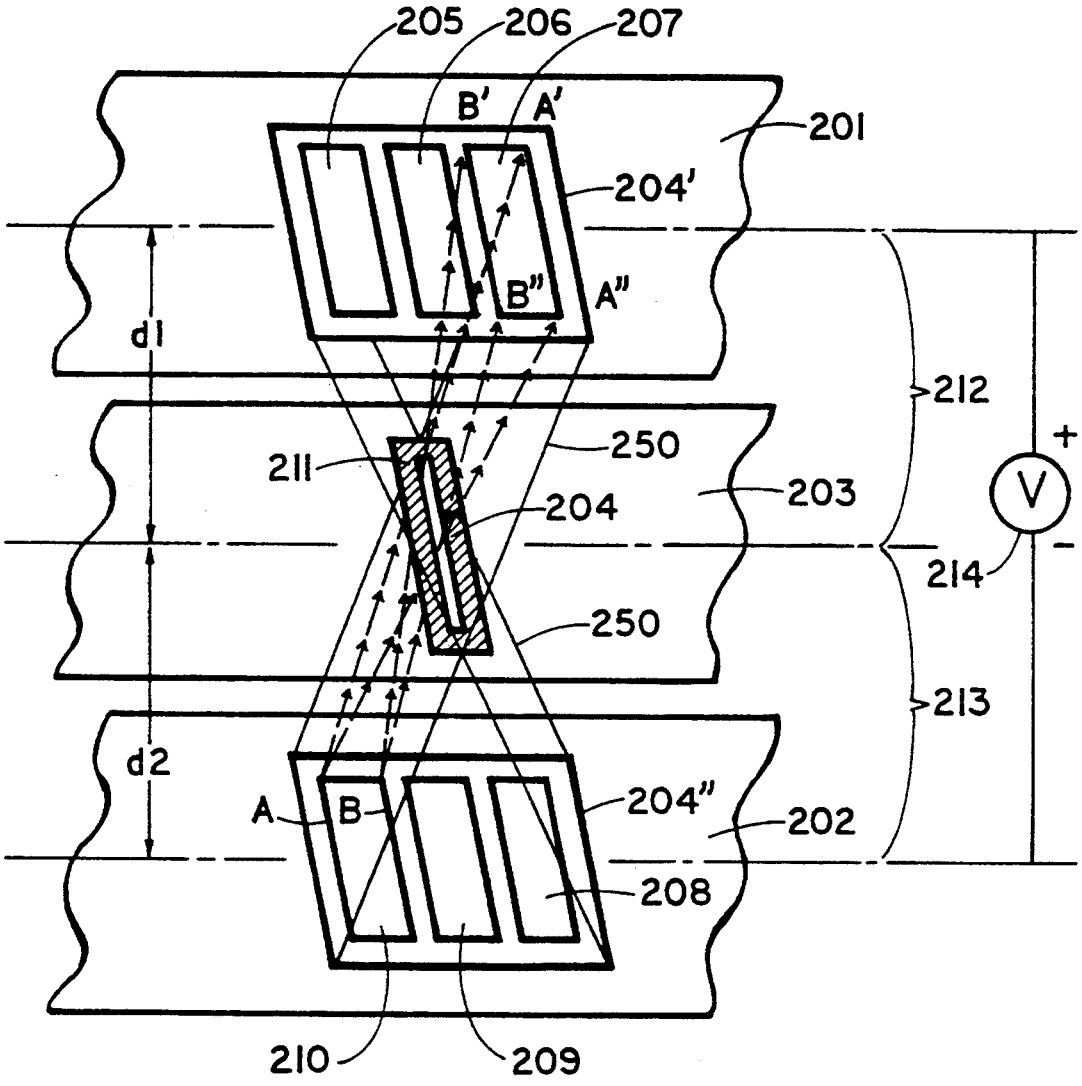
FIG. 2 is a perspective simplified view of a display device using a small aperture or pin hole and an electric field for directing electrons through the pin hole originating from three adjacent groups of cathode sources in order to create essentially non-overlapping images of the three groups of cathode sources to illustrate the invention.

FIG. 1 is a simplified schematic view of a display device using a small aperture or pin hole 101 and an electric field for directing electrons through the pin hole originating from adjacent cathode sources 105 in order to create essentially non-overlapping images of the cathode sources to illustrate the invention. In FIG. 1, 106 is the mechanical passage or channel in the spacer means 107, 101 is the pin hole, 102 is a planar cathode, 103 is a planar anode, 104 is the electrical potential exerted on the anode to form an electric field between the anode and cathode, and 105 are two electron point source cathodes situated on positions A and B on the planar cathode. A portion of the electrons, once emitted from A under the influence and constraint imposed upon them by the anode potential and the pin hole 101, will follow a possible path defined between AA′ and AA″. A portion of the electrons from B will follow paths defined between BB′ and BB″. The widths of A′A″ and B′B″ depend on the size of the pin hole 101 and the distances D1 and D2 between the face plate and the pin hole and between the back plate and the pin hole respectively, FIG. 2 is a perspective simplified view of a display device using a small aperture or pin hole and an electric field for directing electrons through the pin hole originating from three adjacent groups of cathode sources in order to create essentially non-overlapping images of the three groups of cathode sources to illustrate the invention. In FIG. 2, 201, 202 and 203 are three parallel planes, representing respectively an anode plane, a cathode plane and a center plane of a composite spacer plate structure formed by two spacer plates 212, 213 stacked up on each other to form a composite spacer plate, the aperture or pin hole being located in such center plane 203, a first spacer plate 212 between and in contact with anode plane 201 and center plane 203 and a second spacer plate 213 between and in contact with cathode plane 202 and center plane 203. In FIG. 2, the two spacer plates 212 and 213 each define therein two funnel-shaped portions with surfaces 250 of a single channel or passage in the two spacer plates; 214 is a voltage source that creates an electric field between 201 and 202; 205, 206 and 207 are three phosphor strips defined on the anode plane 201 within a rectangular or square wedge-shaped hole 204′ of the first spacer plate, defining three pixel dots 205, 206, 207 of the same shape and size; 208, 209 and 210 are three field emission cathode groups defined on the cathode plane 202 within a rectangular or square hole 204″ of the second spacer plate. Thus hole 204′ forms the wide end of the funnel-shaped channel 250 in plate 212 and hole 204″ forms the wide end of the funnel-shaped channel 250 in plate 213; the narrow ends of the two funnel-shaped channels are aligned and converge to form rectangular pin hole 204 on the center plane 203 of the composite spacer plate.

Numeral 211 marks an electronic lens electrode in association with said pin hole. In other words, the channels are the narrowest at said aperture or pin hole and increase in their cross-sectional dimensions from the aperture towards the face and back plates. Electrode 211 is a conductive layer surrounding aperture 204. When positive voltage with respect to the point source cathodes is applied to electrode 211, it would act as an electronic lens to help electrons emitted from the point source cathodes to form an initial velocity between the cathode and the aperture, and eventually pull these electrons through the aperture so that they can follow their initial velocity and proceed to hit a particular spot on the anode, where at this particular spot, together with the center of the aperture and the point source cathode would tend to form a straight line.

The field emission cathode group 210 is formed by many tiny electron point sources of field emission cathode at and between edges A and B. In this example, electrons emitted from point field emission cathodes along the edge A of cathode group 210 would be carried by their momentum as well as attracted by the positive electric field of the anode, and influenced by the electrical potential of the electronic lens electrode at the pin hole and dash through the pin hole towards the edge A'A" of pixel dot 207. Same phenomenon will happen to electrons from point field emission cathodes between edges A and B of group 210 and cause them to dash to points between edge A'A" and B'B" of pixel dot 207 on the anode. It is by this same token that the electrons from other field emission group 208, 209 will dash through the rectangular pin hole 204 and strike on phosphor strips 205, 206 and cause them to light up.

The distance d1 between the pin hole and the anode is so small that once the electrons originating from group 210 emerge from the pin hole, they would not be detoured to 206 or 205, but would only follow their initial paths influenced by the electrical potential of the electronic lens electrode, and find their respective image positions on pixel dot 207. The electronic lens electrode 211 would help to pull more electrons from 210 and help them to form their direction and accumulate enough initial speed so that after their emergence from pin hole 204, they would be guided by their initial course and hit a well defined image area 207 on the anode. Since pin hole 204 is small compared to the wide ends 204' and 204" of the funnel-shaped channels in the said spacer structure, the structure will provide the much needed mechanical strength for supporting the face and back plates against atmospheric pressure, and the much needed protection to the cathode from the bombardment and contamination of the positive ion and decomposed material from the phosphor coated anode. Furthermore, such a structure will greatly reduce cross talk between adjacent pixel dots and provide uniform support between the anode and cathode.

Figure 3A:
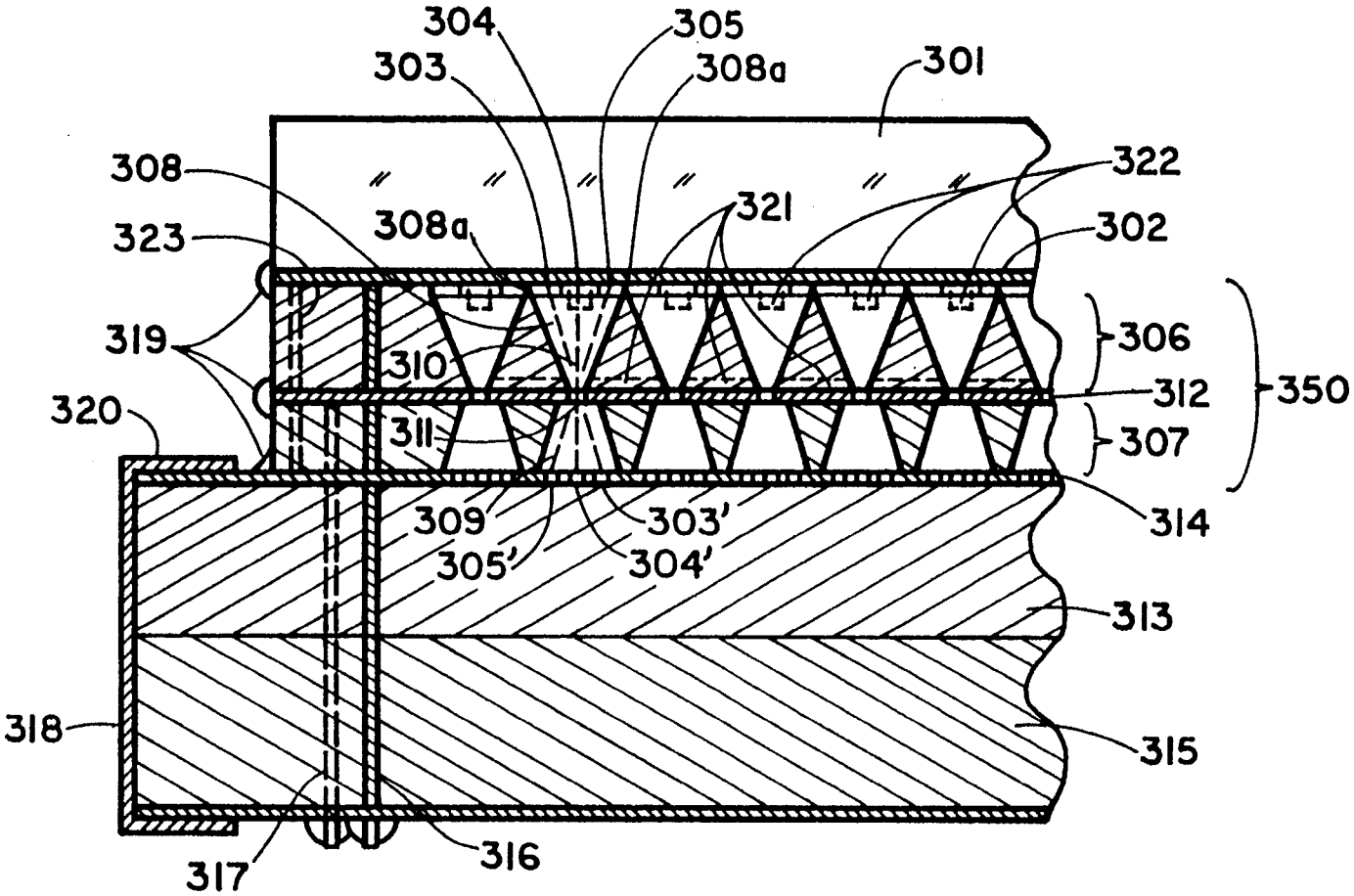
FIG. 3A is a partial cross sectional view of a display device illustrating a preferred embodiment of this invention.
Figure 3B:
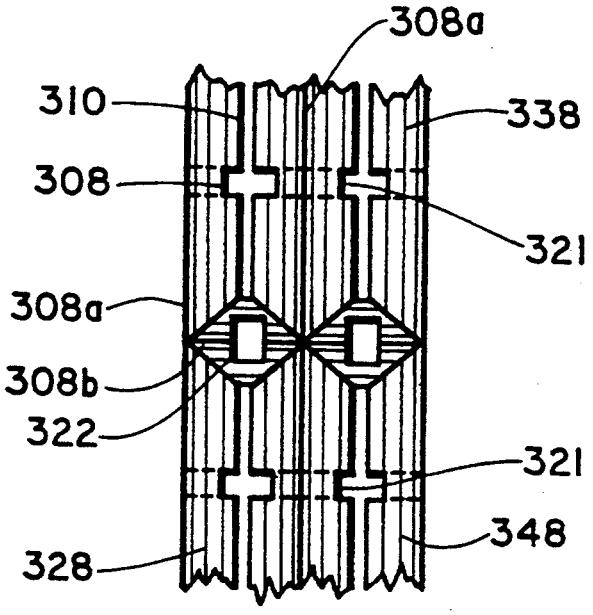
FIG. 3B is a top view of a four holes section of the spacer plate of FIG. 3A.
Figure 3C:
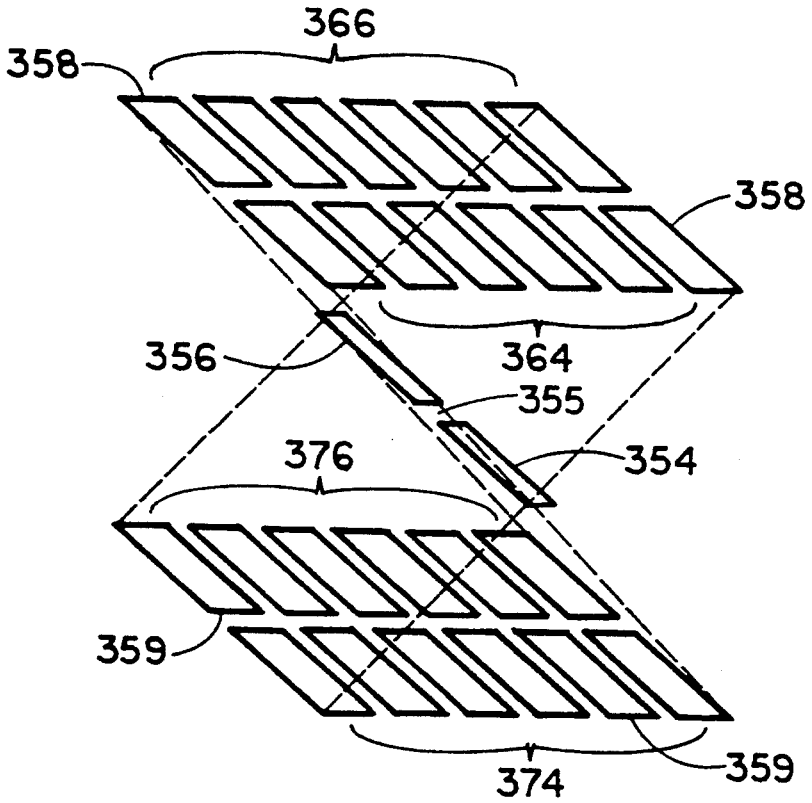
FIG. 3C is a simplified perspective schematic view of a display device illustrating another preferred arrangement of phosphor dots and point source cathodes within definition of each hole of the spacer plate.

FIG. 3A is a partial cross sectional view of a display device illustrating a preferred embodiment of this invention. FIG. 3B is a top view of a four holes section of the spacer plate of FIG. 3A. FIG. 3C is a simplified perspective schematic view of a display device illustrating another preferred arrangement of phosphor dots and point source cathodes within definition of each hole of the spacer plate.

In FIG. 3A, 301 is a transparent face plate; 302 is the anode made of a transparent conductive layer, such as ITO or SnO2 film; 303, 304 and 305 are red, green and blue phosphor dots also defining pixel dots; 306 and 307 are spacer plates. Both plates are made of UV-sensitive glass-ceramic type of material and photo-chemical process can be used to obtain fine geometries of the channels therein. They stack up to form a composite spacer plate 350. The relative positions between the two component spacer plates in the composite spacer plate as well as the relative positions of the composite spacer and face and back plates can be aligned through alignment holes 323 provided on the peripheral of the spacer plates and adhesive means can be used to secure their relative positions. In FIG. 3A, 308 and 309 are one set of the rectangular wedge-shaped funnel-shaped holes that converge toward the center plane of the composite spacer plate to form a smaller rectangular pin hole defined by the two smaller rectangular holes 310 and 311 at the narrow ends of holes or channels 308, 309. These holes can be square wedge-shaped, rectangular wedge-shaped, or cone-shaped depend on different applications. For square or rectangular funnel-shaped channels, the four walls of these holes can be all wedge-shaped to provide better strength for the spacer plate in a high resolution format. Also the size of hole 311 in the lower spacer plate 307 can be bigger than, equal to or less than the size of hole 310 in the upper spacer plate 306, again depending on different applications.

The thicknesses of spacer plate 306 and 307 are d1 and d2 respectively, and d1 can be bigger than, equal to or less than d2. At the wide end of channel 308 is a pixel group of three phosphor dots 303, 304 and 305. On the back plate are three field emission cathode groups 303', 304' and 305', each operated as an independent electron point source cathode and is defined by hole 309. The number and shape of these field emission groups correspond to the number and shape of the phosphor dots at the wide end of channel 308 on the anode. The size of groups 303', 304' and 305' can be bigger than, equal to or less than the size of their respective counter parts or phosphor dots 303, 304 and 305, depending on the design of the spacer means and of the electronic lens electrode, in order to obtain best focusing effects on the anode. But for the ones who are experts in this art, it is obvious that these numbers can be varied depending on what is needed in the resultant resolution.

FIG. 3C illustrates schematically an arrangement where the number of groups of point cathodes that generate electrons passing through a particular aperture or pin hole as well as the number of pixel dots that generate light in response to electrons are different from those in FIG. 3A. The 12 phosphor dots 358 form two clusters 364, 366 of 6 phosphor or pixel dots each, where each cluster forms 2 pixel groups of 3 pixel dots each. The 12 groups of point source cathodes 359 form two clusters 374, 376 of groups of cathodes. Electrons generated by cluster 374 will pass through aperture 354 to cause cluster 364 of pixel dots to emit light. Electrons generated by cluster 376 will pass through aperture 356 to cause cluster 366 of pixel dots to emit light. Thus, clusters 364, 374 and aperture 354 form a set of corresponding clusters and aperture, and cluster 366, 376 and aperture 356 form a set of corresponding clusters and aperture, where each cluster or aperture is an element of the set. The two sets of corresponding clusters and apertures may be within the same channel in the spacer means or within two separate channels. If located within the same channel, apertures 354, 356 may be formed from a longer aperture by a narrow strip 355 dividing the longer aperture into two shorter ones.

In FIG. 3A, 312 refers to a conductive layer which is deposited on top of spacer plate 306 or 307 in association with the plate with the smaller holes, wherein when the two spacer plates are stacked up to form a composite spacer plate, this layer would be sandwiched between two spacer plates and forms an electronic lens electrode surrounding each small pin hole for attracting electrons from the electron point source cathodes to pass through the pin hole and focusing these electrons onto the anode. Such lens electrode is shown more clearly as electrode 211 in FIG. 2.

In FIG. 3A, electrode 312 can be common to an entire array of pin holes or apertures. Alternatively, it can be a group of parallel elongated electrodes, each for focusing electrons passing through a pin hole in the pin hole array, or still another different arrangement, depending on the needed resultant resolution. In some applications, if the channel is formed by high resistivity material or coated with high resistivity coating, by adjusting the spacing and diameters of the rectangular wedge-shaped holes as well as the thickness of the two spacer plates, electrode 312 can be eliminated for a more simplified process. In FIG. 3A, 313 refers to a back plate, and 314 refers to a field emission cold cathode group array formed on the inner surface of the back plate; 315 is a printed circuit board (PCB) to provide driving circuitry for the display device; 316 marks a conductive lead for the anode; 317 refers to a conductive lead for the electronic lens electrode; 318 refers to the conductive leads of the gate and base electrodes of the point source cathode array and 319 is glass frit for sealing the device. Other means, such as chip on glass bonding, may simplify the connection scheme by mounting integrated circuits (ICs) on the extended edge 320 of the back plate, wherein a two dimensional addressing matrix electrodes designed to control the point source cathode array through their gate and base electrode, as well as the electronic lens electrode, can be pre-formed by generally known techniques in the IC and thick film industry. In such a case, the leads 317 and PCB 315 are not needed.

Small grooves 321 are etched on the bottom surface and small grooves 322 on the top surface of spacer plate 306 in FIG. 3A, through a photo-chemical process. These grooves are shown more clearly in FIG. 3B, which is a top view of a portion of the spacer plate 306 showing wedge-shaped channel 308 and three additional adjacent wedge-shaped channels 328, 338, 348. Ridges **308*a*, 308*b* define the wide end of the channel 308. The ridge 308*a* adjacent to channel 338 separates channels 308, 338. Conduit 321 on the bottom surface of plate 306 connects channels 308, 338. Ridge 308*b* adjacent to channel 328 separates channels 308, 328. Conduit 322 at such ridge connects channels 308, 328. Therefore, if channel 308 is evacuated, channels 328, 338 will also be evacuated. In the same manner, grooves 321, 322 connect the entire array of channels in the spacer plates 306, 307**, so that by evacuating one channel, a vacuum environment can be created through out all the holes or channels of the array.

Figure 3D:
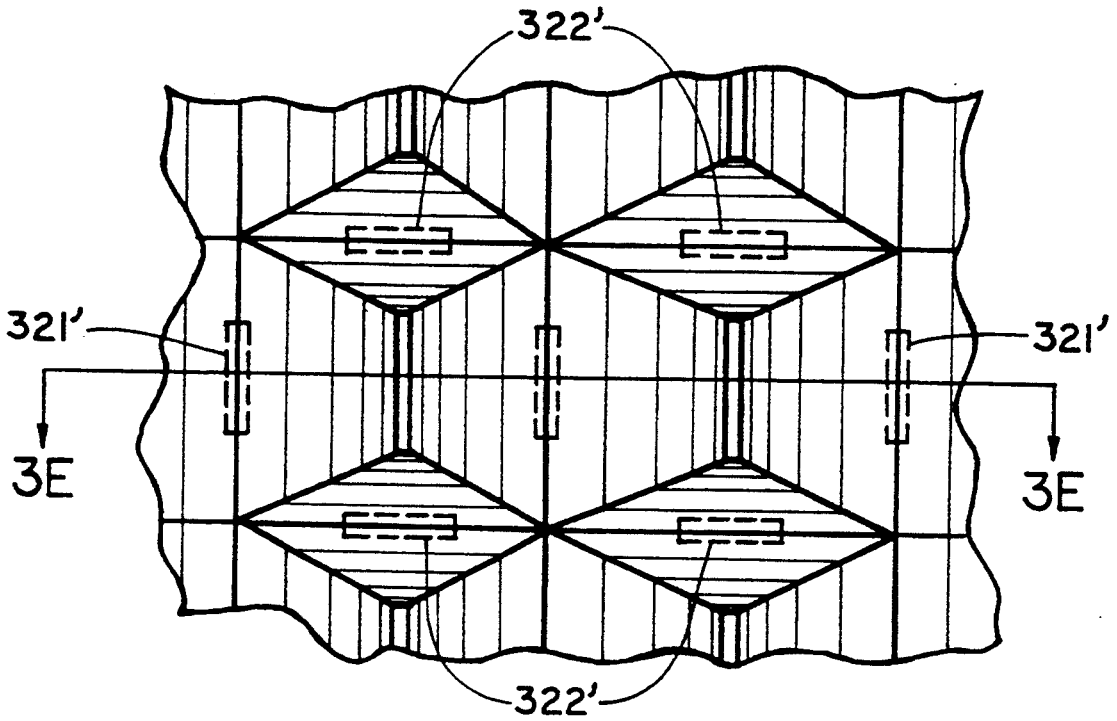
FIG. 3D is a top view of a portion of the spacer plates 306', 307'.
Figure 3E:
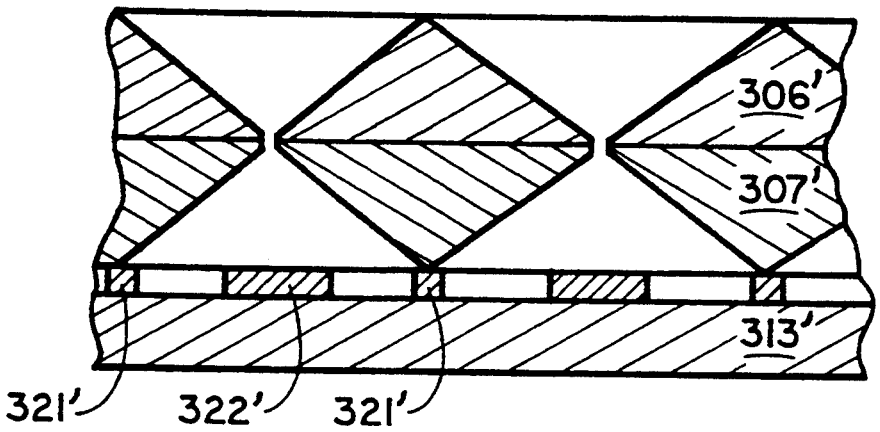
FIG. 3E is a cross-sectional view of spacer plates of FIG. 3D and of the back plate taken along the line 3E—3E in FIG. 3D.

Instead of providing grooves in the spacer plate 306, the same feature of connecting the entire of channels can be achieved by providing raised pillars 321' and 322' that can also be deposited on either the bottom surface of spacer plate 307, the top surface of back plate 313, on the top surface of spacer plate 306 or the bottom surface of face plate 301. FIGS. 3D, 3E illustrate the construction where the pillars are deposited on the back plate. FIG. 3D is a top view of a portion of the spacer plates 306' 307' where spacer plates 306', 307' are similar to spacer plates 306, 307 of FIG. 3A except that plates 306', 307' do not have grooves 321, 322 therein. FIG. 3E is a cross-sectional view of spacer plates of FIG. 3D and of the back plate taken along the line 3E—3E in FIG. 3D.

Figure 3F:
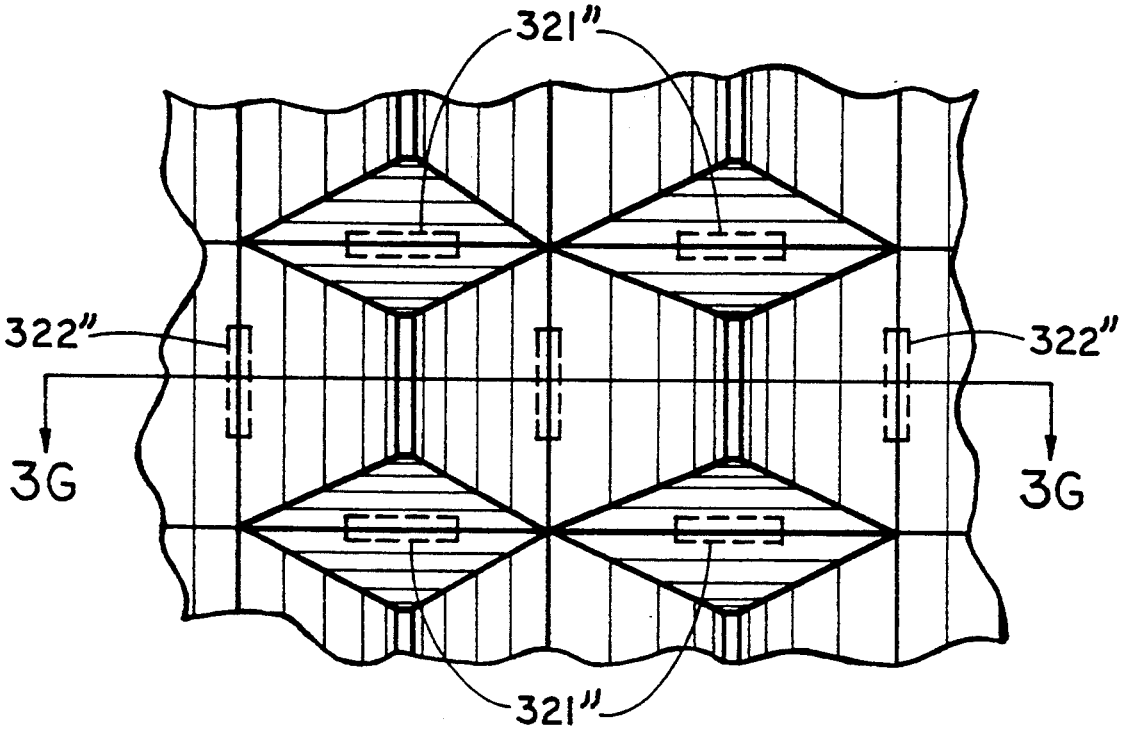
FIG. 3F is a top view of a portion of the spacer plates 306", 307".
Figure 3G:
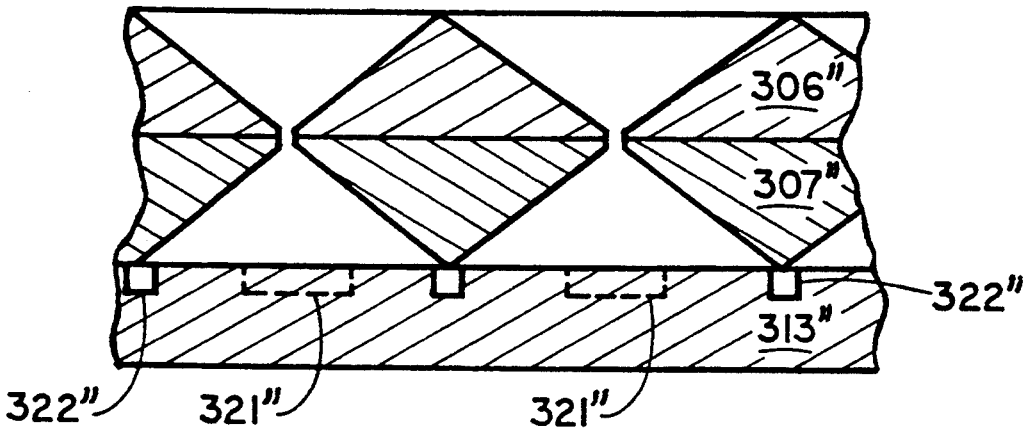
FIG. 3G is a cross-sectional view of spacer plates of FIG. 3F and of the back plate taken along the line 3G—3G in FIG. 3F.

Still another different configuration for the conduits is illustrated in FIGS. 3F, 3G. FIG. 3F is a top view of a portion of the spacer plates 306", 307" similar to plates 306, 307 but without grooves 321, 322; FIG. 3G is a cross-sectional view of spacer plates of FIG. 3F and of the back plate taken along the line 3G—3G in FIG. 3F. Grooves 321", 322" are formed on the back plate 313" to connect the entire array of channels in the spacer plates 306", 307". The above described grooves and pillars in reference to FIGS. 3A, 3B, 3D, 3E, 3F, 3G may be formed by chemical etching or screening glass frit method or techniques generally known in the IC and thick film industries.

Figure 3H:
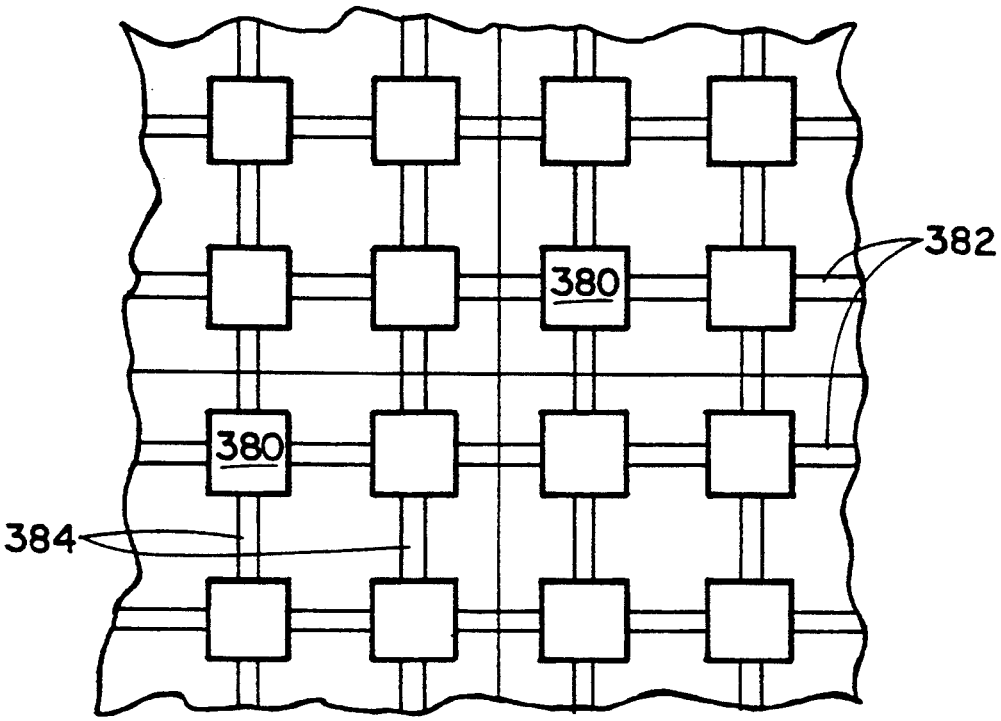
FIG. 3H is a top plan view of a portion of the back plate with an array of groups of cathodes thereon together with connections for the gate and base electrodes of the cathodes.
Figure 3I:
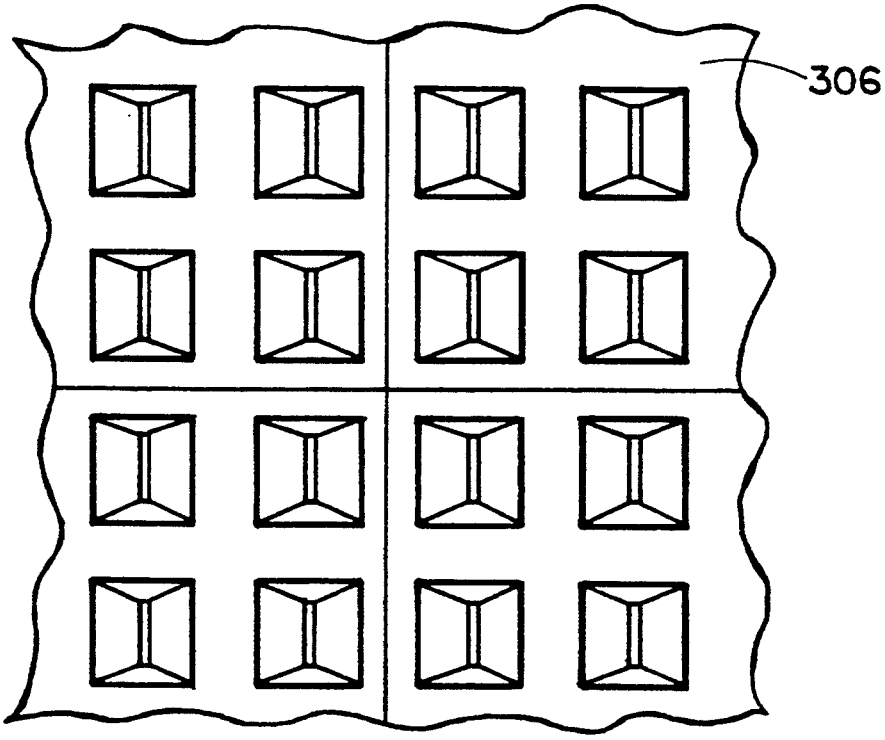
FIG. 3I is a top plan view of a portion of the spacer plate 306 illustrating an array of channels, each channel corresponding to a cluster of groups of cathodes in FIG. 3H and to a cluster of pixel dots on the anode.

FIG. 3H is a top plan view of a portion of the back plate with an array of groups of cathodes thereon together with connections for the gate and base electrodes of the cathodes. FIG. 3I is a top plan view of a portion of the spacer plate 306 illustrating an array of channels, each channel corresponding to a cluster of groups of cathodes in FIG. 3H and to a cluster of pixel dots on the anode (not shown). As shown in FIG. 3I, spacer plate 306 may comprise an array of smaller spacer plates aligned with the face and back plates illustrated in more detail in FIG. 10. Thus, FIG. 3H illustrates an array of sixteen clusters of groups of cathodes 380 with conductive traces 382 for connecting the base electrodes of the array and conductive traces 384 of a different layer than traces 382, for connecting the gate electrodes of the array. As shown in FIG. 3H, each sub-group of four clusters are formed on a substrate different from the substrates of the other sub-groups. Each substrate is then assembled on the back plate using conventional surface mount or chip or glass technique to form a whole cathode electrode for the apparatus, when a large screen display is desired.

Figure 4A:
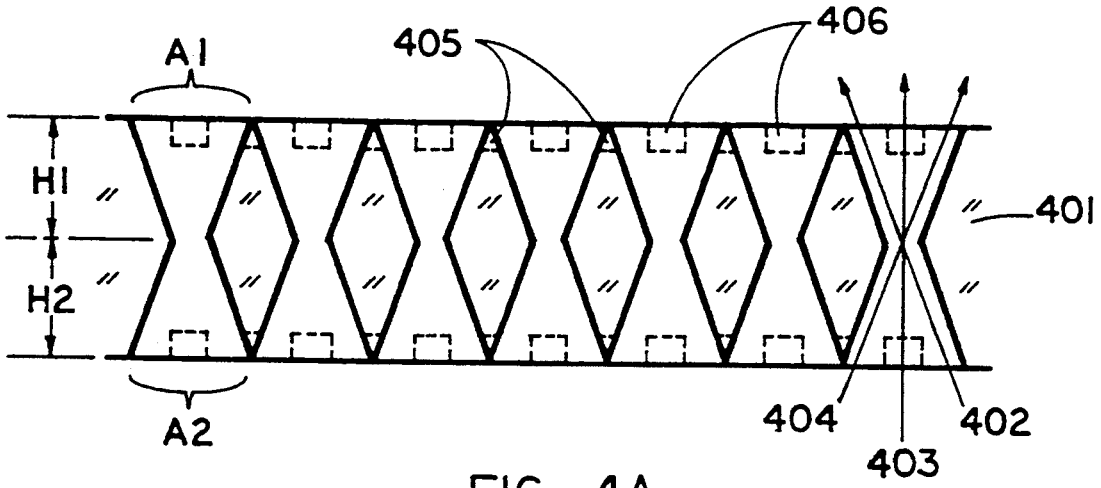
FIG. 4A is a cross sectional view of another preferred embodiment of the spacer structure and FIG. 4B is a top view of a four hole section of the spacer structure.
Figure 4B:
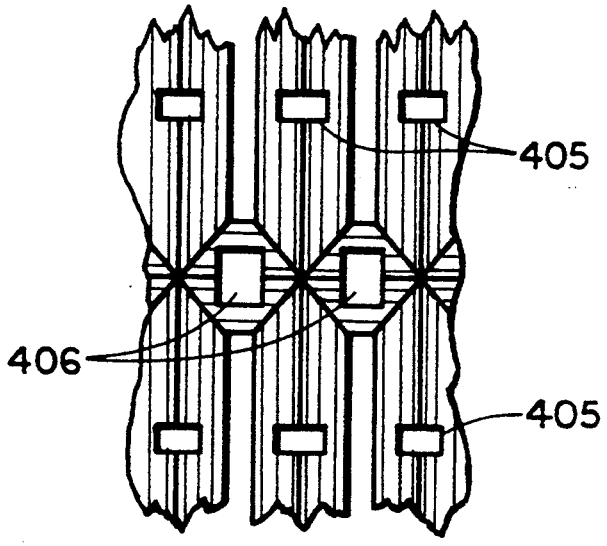

FIG. 4A shows another preferred embodiment illustrating a display employing a unitary spacer plate instead of the composite spacer plate shown in FIG. 3A. In FIG. 4A, 401 refers to a single piece spacer plate made of UV-sensitive glass-ceramic type of material. By using multiple exposing and etching process steps a structure similar to that described above as the composite spacer plate 350 of FIG. 3A can be produced. The only thing that is missing in this alternative preferred embodiment is the electronic lens electrode made possible by the conductive layer sandwiched between the two spacer plates in FIG. 3A. In the embodiment of FIG. 4A, when the channel is coated with a high resistivity material, a proper ratio of the hole diameters A1/A2 and hole depth H1/H2 is selected so that the electronic lens electrode is not needed for focusing function and the pin hole image effect described above can still be obtained through the typical electron path defined by 402, 403 and 404. This single piece spacer plate can replace the above mentioned composite spacer plate in the previous described embodiment and further simplifies the structure and process of the display device. The numerals 405 and 406 refer to grooves etched on ridges on the surface of the spacer plate in a manner similar to grooves 322 of FIGS. 3A, 3B to connect all the holes together to form a vacuum environment and are more clearly shown in FIG. 4B, which is a top view of a portion of the spacer 401 of FIG. 4A. Again, grooves 405 and 406 can be replaced by raised pillars in a manner similar to that shown in FIGS. 3D, 3E, deposited on the bottom surface of the spacer, or on the back plate by chemical etching or screening glass frit, or techniques generally known in the IC and thick film industries.

Figure 5:
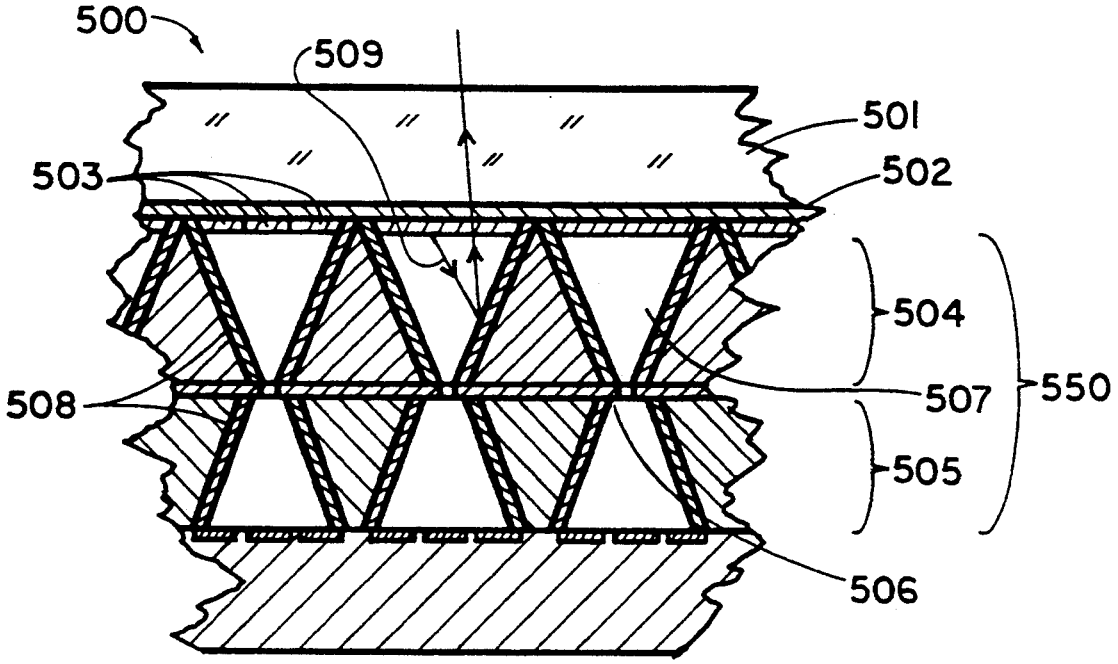
FIG. 5 is a cross section view of a portion of a display device illustrating a method to eliminate trapped electrons on the inside surface of holes of the said spacer structure and reflection of back travelling light towards the front of the device to enhance efficiency.

FIG. 5 further illustrates a method for improvement of image brightness and focusing by removing electrons trapped on the inside surface of the array of channels such as channels 507 in the top spacer plate 504. These trapped electrons will create a negative electric field inside the holes, wherein free electron passage will be hindered. In FIG. 5, 501 refers to the face plate, 502 to the transparent conductive film, 503 to the three phosphor dots on the anode, and 504, 505 to two spacer plates that forms the composite spacer plate 550. Device 500 also has electronic lens electrode 506, and 507 marks the rectangular wedge-shaped channel of the plate 504, and 508 refers to a high reflective coefficient coating that would reflect the back travelling (towards the back plate) incident light 509 from the phosphor layer towards the face plate. Since the size of the pin hole is very small compare to the opening of the wedge-shaped channel, most of the back incident light from the phosphor dots will end up reflected back through the face plate and thus increase the brightness of the device. The reflection layer 508 is preferably also a high resistance layer in the range of 100 mega-ohms to 1,000,000 mega-ohms. It will provide a high resistance path for the trapped electrons to go to the phosphor layer or the electronic lens electrodes and thus eliminates the electron build up on the inside surface of the holes. The spacer plate is made of a high resistance glass-ceramic type of material of white color. So in some applications, it would serve the above purpose and there will be no need for additional coating on the spacer plate.

Figure 6A:
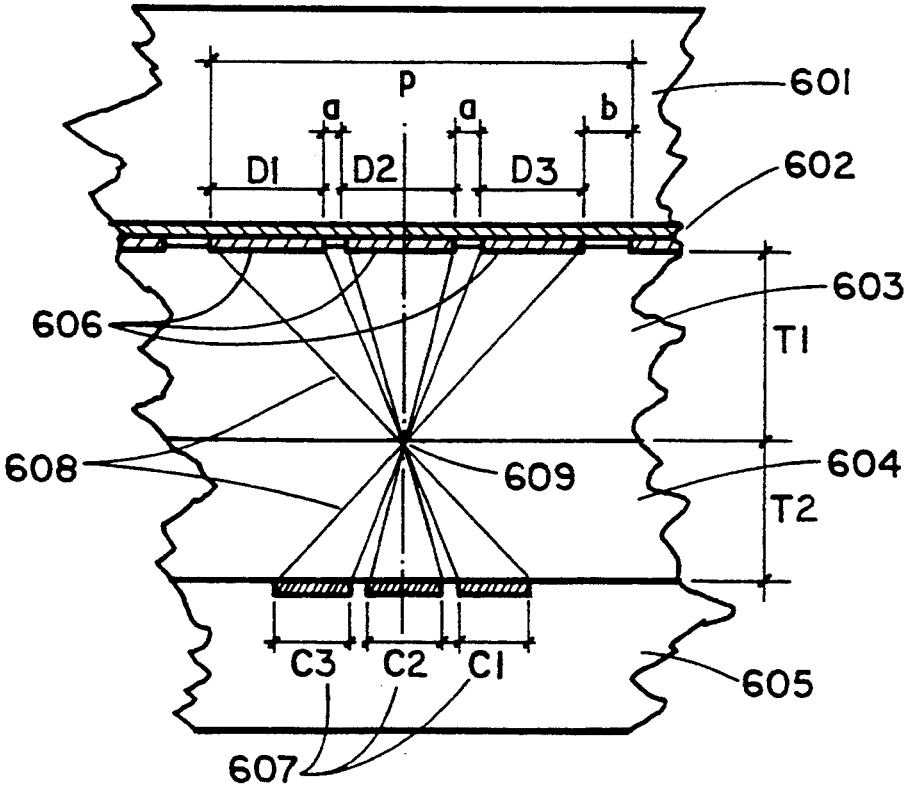
FIG. 6A is a cross section view of a portion of a display device showing a single pin hole within the said spacer structure for creating images of the cathodes to illustrate this invention, said device provided with black insulating layers for enhancing contrast.
Figure 6B:
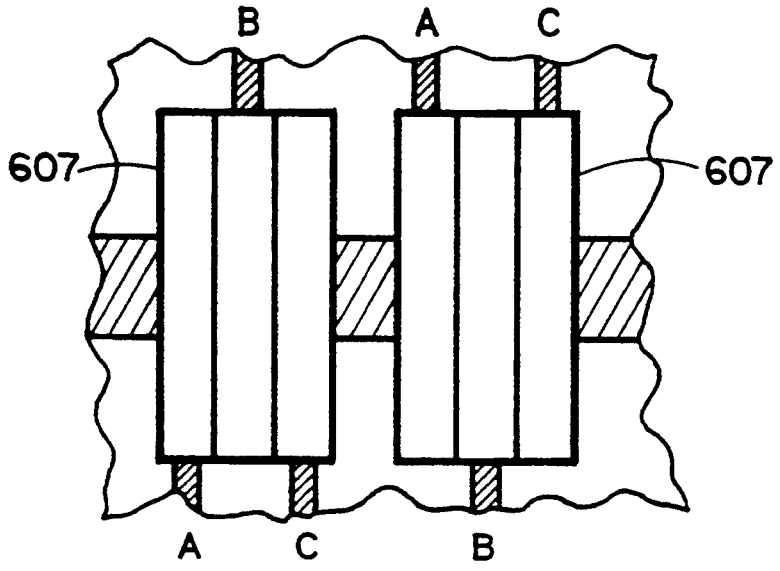
FIG. 6B is a schematic view of two groups of microtip cathodes, each further divided into three subgroups.
Figure 6C:
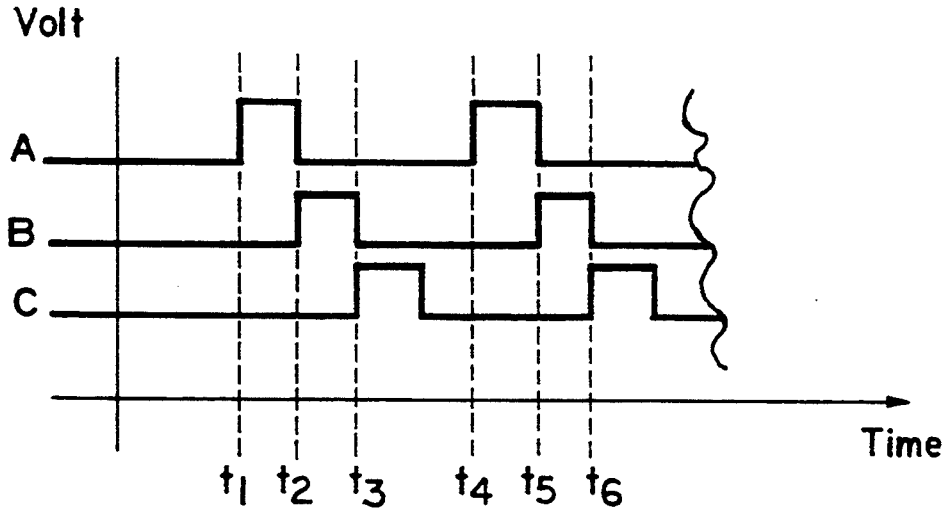
FIG. 6C is a timing diagram illustrating a sequential addressing scheme for causing each subgroup to emit electrons sequentially to increase the lifetime of the microtip cathodes.

FIG. 6A shows a more detailed cross sectional view of one of the wedge-shaped channel of the spacer plate, where 601 refers to the transparent face plate, 602 to a transparent conductive layer, 603 to a top spacer plate, 604 to a bottom spacer plate; that is, 603 and 604 forms the single piece spacer plate. T1 is the thickness of first spacer plate and T2 is the thickness of the second plate, and 605 refers to a back plate, 606 to the R.G.B. phosphor dots and 607 to the field emission cathode groups. Numeral 608 refers to the two rectangular wedge-shaped channels and 609 to a rectangular pin hole or aperture. The symbol a marks a black insulating layer between phosphor dots, and b a black insulating layer between each phosphor pixel dot group and an adjacent group. P is the pixel pitch. D1, D2 and D3 are the widths of the phosphor dots. C1, C2 and C3 are widths of the field emission cathode group. FIG. 6B is a schematic view of two groups of microtip cathodes, each further divided into three sub-groups. FIG. 6C is a timing diagram illustrating a sequential addressing scheme for causing each subgroup to emit electrons sequentially to increase the lifetime of the microtip cathodes.

As an example, typical values may be selected for the following parameters as follow: P=0.317 mm, (corresponding to 10" VGA full color display or 16" XGA full color display or 23" HDTV format) a=0.01 mm, b=0.057 mm, T1=1.5 mm, T2=1 mm, D1=D2=D3=0.08 mm. In such event, the spacer plate would have roughly a 25.4 mm/0.317 mm=80 hole/inch density hole array on both of its surfaces while the wide ends of the channels defining holes at the anode is 0.317 mm in diameter and the wide ends of the channels defining holes at the cathode is 0.236 mm. in diameter. Then C1=C2=C3=T2×D2 /T1=0.053 mm. For a square hole, the length of C1 is T2(0.317–0.057)/T1=0.173 mm. If the pitch of the microtip emitters within each of the field emission cathode group is 5 um, then there will be 53/5×173/5=340 microtip emitters in each of the point source cathode.

If average current emitted from each microtip is 5 microamperes/tip, anode voltage (W) is 2000 volts, duty factor (DF) is 120% of scan line, assuming luminous efficiency (n) is 3 lm/W for white light, the average brightness B of such a display device will be:

$$B=((nWa\times 3\times D1\times(P-2a-b))/\pi S_L P^2(DF)=(3\times 2000\times 340\times 5\times(10-6))/(3.14\times 3.17\times(10-4)\times 3.17\times(10-4)\times 480\times 1.2)=560{,}000 \text{ cd/sq. meter}$$

In the above calculation, $S_L$ is the number of scan lines, which is assumed to be 480. One can see that although very conservative performance parameters are used here for the microtip cathodes, tremendous brightness still results from the theoretical calculation. Even after a thousand fold reduction would still yield a very bright device.

In order to increase the life time of the cathode, the microtip cathodes of the field emission cathode group can be further divided into several sub-groups and operate alternately during the normal operation. In another case, if life time of the microtip cathodes is not an issue, the abundance of brightness can be traded for brightness uniformity by destroying unwanted microtips through the use of laser blast to create uniform brightness within the field emission cathode group array.

The above mentioned scheme of dividing the microtip cathodes into sub-groups is illustrated in FIGS. 6B, 6C. As shown in FIG. 6B, each group of cathodes 607 is further divided into three sub-groups: A, B and C. Thus, at time t1, address pulses cause the microtip cathodes in sub-group A to emit electrons. Then subsequently, at time t2, addressing pulses cause the sub-groups B of microtip cathodes to emit electrons at a still later time, addressing pulses cause the microtip cathodes in sub-groups C to emit electrons. The above cycle is then repeated at subsequent times t4, t5 and t6, and so on.

Figure 7:
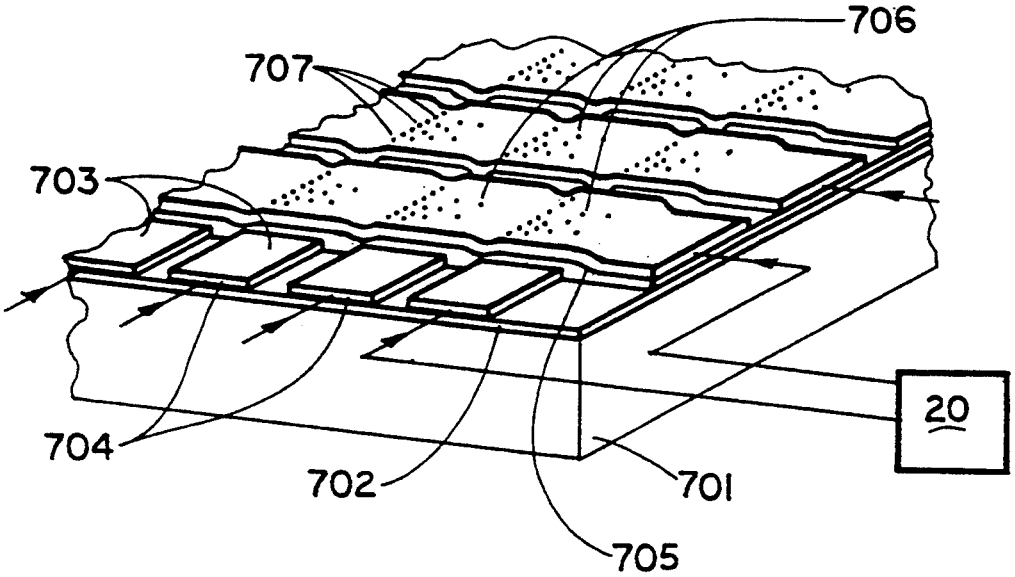
PRIOR ART FIG. 7.
FIG. 7 is a perspective view of a conventional implementation of an array of field emission groups on a back plate and a power source for addressing the array.

FIG. 7 is a perspective view of a conventional implementation of an array of field emission groups on a back plate and a power source for addressing the array. In FIG. 7, 701 refers to a glass substrate of a back plate, 702 to a silica film, 703 to parallel strips of conductive layers serving as base electrodes for field emission cathode group array. Numeral 704 represents a set of these electrodes, and 705 refers to another insulation layer of silica, which covers the whole array of the field emission cathode groups, only exposing the base electrode on both sides of the array for outside connection purpose. Numeral 706 refers to parallel strips of conductive layer serving as gate electrode for the field emission cathode group array, and 707 are field emission cathodes within each field emission cathode group. Electrodes 703 and 706 form a X, Y matrix for addressing as well as controlling the emission rate of the field emission cathode group array to serve as a point source cathode for the present invention. The electrode arrangement and addressing of the devices of this invention may be implemented in a way similar to those illustrated in FIG. 7.

Figure 8:
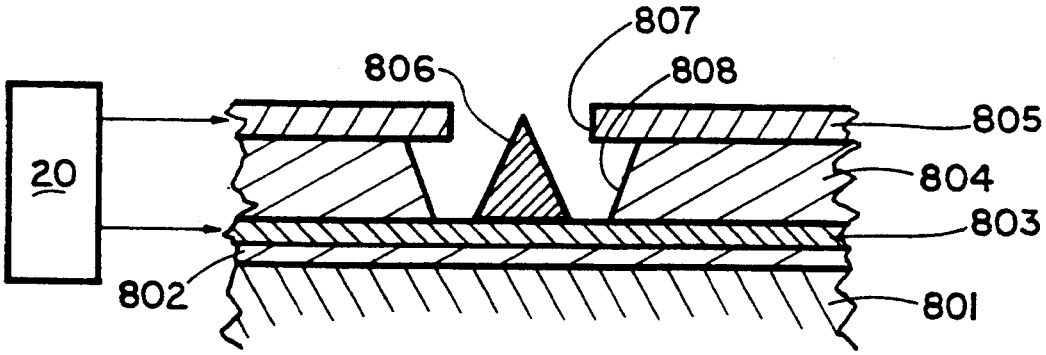
PRIOR ART FIG. 8.
FIG. 8 is a cross sectional view of a conventional typical microtip field emission cathode device.

FIG. 8 is a cross sectional view of a conventional typical microtip field emission cathode device, 801 refers to a glass substrate of the back plate, 802 to an insulation silica layer, 803 to a conductive layer for forming base electrodes, 804 to an insulation layer, 805 to a conductive layer for forming gate electrodes, 806 to microtip electron emitters of high temperature melting metal, such as molybdenum, formed by evaporation method, 807 to an opening of the gate electrode through which the microtip emitter emits electrons, 808 to an opening in the insulating silica layer through which the microtip can be deposited. When an electrical potential of approximately 100 volts by power supply circuit 20 between the gate electrode 805 and base electrode 803, the microtip 806 will emit 15 electrons. Typically, the diameter of the microtip is about 1.4 um, the pitch of the tips is about 5 um and the average current emitted from each tip in normal operation range can be up to 10 microamp./tip or more.

Figure 9A:
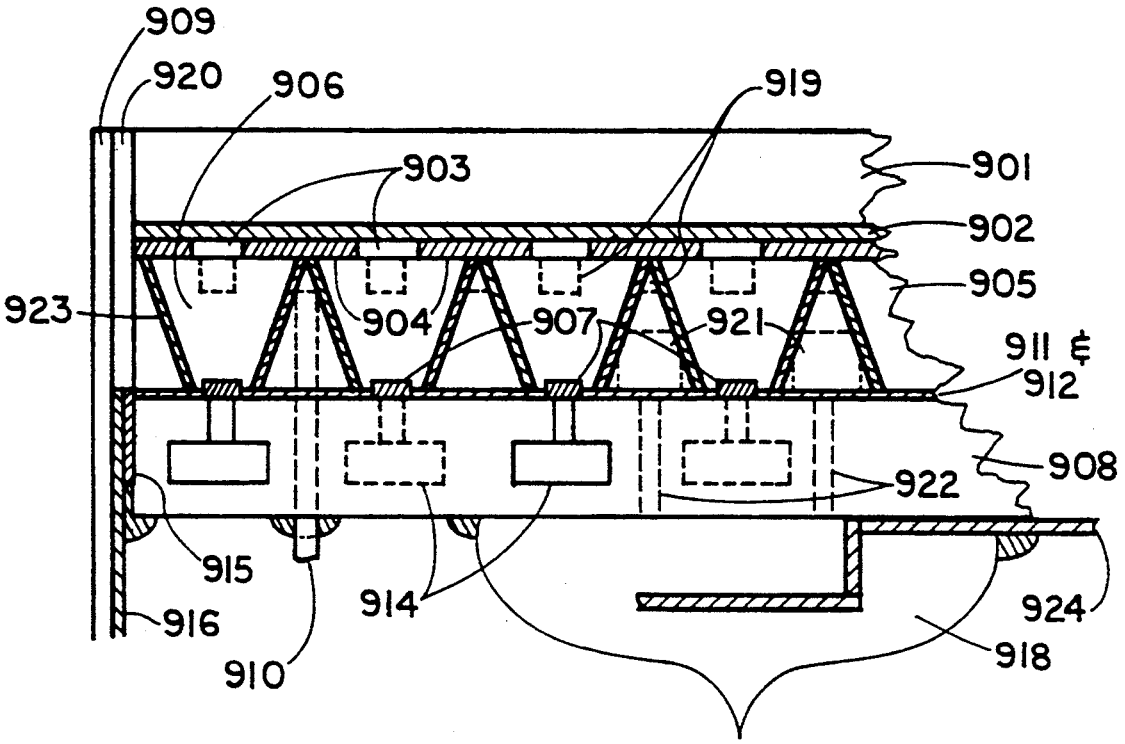
FIG. 9A is a cross section view of a portion of a display device particularly suitable for low resolution mosaic tile application.
Figure 9B:
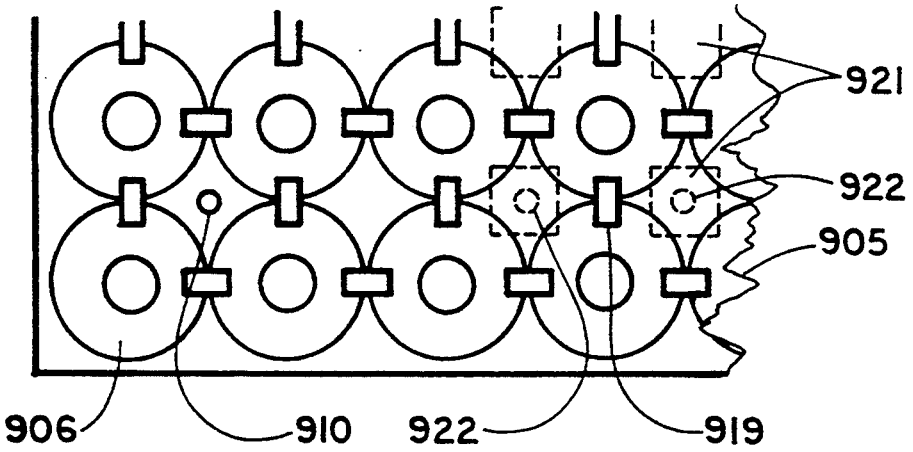
FIG. 9B is a top view of a portion of the spacer structure of FIG. 9A.
Figure 9C:
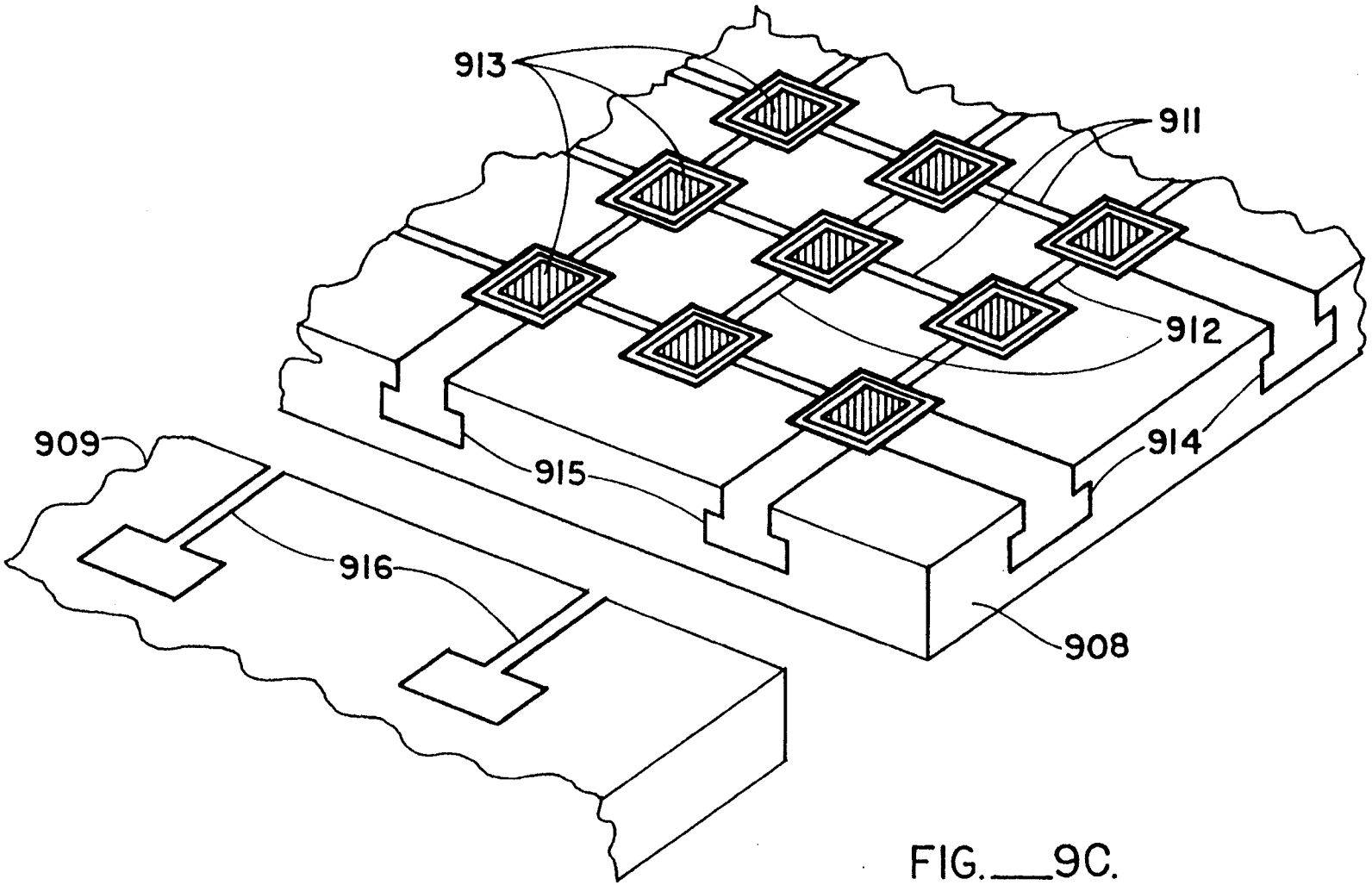
FIG. 9C is a perspective view of a portion of the back plate and side wall of the device in FIG. 9A illustrating a field emission cathode group array on a back plate and electrical traces on the back plate and side wall for the housing, illustrating how the array can be electrically connected to devices outside the housing.

FIG. 9A is a cross section view of a portion of a display device particularly suitable for low resolution mosaic tile application. FIG. 9B is a top view of a portion of the spacer structure of FIG. 9A. FIG. 9C is a perspective view of a portion of the back plate and side wall of the device in FIG. 9A illustrating a field emission cathode group array on a back plate and electrical traces on the back plate and side wall for the housing, illustrating how the array can be electrically connected to devices outside the housing.

In FIG. 9A, 901 refers to a face plate, 902 to a conductive layer for anode, 903 to phosphor dots, 904 to a black insulating layer for separating phosphor dots to provide better contrast, 905 to a single layer spacer having a circular, cone-shaped (can be rectangular or square wedge-shaped) channel array, 906 to one of these cone-shaped channels, 907 to field emission cathode groups serving as the cathode, 908 to a glass substrate back plate, 909 to a thin glass plate side wall with electrode pattern 916 printed on it to serve as leads for outside connection to the base and gate electrodes of the field emission cathode groups.

In FIG. 9C, 911 refers to parallel conductive strips as base electrode deposited on the glass substrate 908, wherein alternate strips will have a large bonding pad 914 deposited on opposite sides of the edge of the back plate perpendicular to the base electrodes, 912 to parallel conductive strips as gate electrodes deposited on the glass substrate, wherein alternate strips will also have a large bonding pad 915 deposited on opposite side of the edge of the glass substrate perpendicular to the gate electrodes, 916 to conductive bonding pads and leads on side wall 909, which will be used to seal the four sides of the structure comprising of the face plate, spacer plate and back plate. Bonding pads 916 will be aligned against bonding pads 914 and 915 so that through leads 916, the base and gate electrodes can be connected to outside electronic control sources for matrix addressing of the display device.

In FIG. 9A, 920 refers to a glass frit material used to seal side wall 909 to the structure, 910 to an anode lead through the back plate for outside anode connection, 919 to small grooves similar to grooves 321, 322 of FIGS. 3A, 3B etched on top of the spacer plate to connect all of the holes or channels in the hole array so that a vacuum environment can be provided by evacuation through a single evacuation outlet 918 which communicates with 4 holes 922 on the back plate for evacuating the device. In FIG. 9A, 921 refers to 4 holes etched from the back side of the spacer plate half way upward until they are connected with the 4 corresponding cone shaped holes. Holes 921 and 922 are aligned on top of each others so that air from the cone shaped hole array can be evacuated out through holes 921, 922 and then outlet 918. The above described evacuation hole and circuit for matrix addressing arrangement can be also applied in the above described preferred embodiments involve two composite spacer plate and single spacer plate of FIGS. 3A–6C. Similarly, the features of the embodiments in FIGS. 3A–6C may also be employed in the embodiment of FIGS. 9A–9C. In FIG. 9A, 924 refers to a getter device, 923 to a reflective coating for brightness improvements if needed.

Figure 9D:
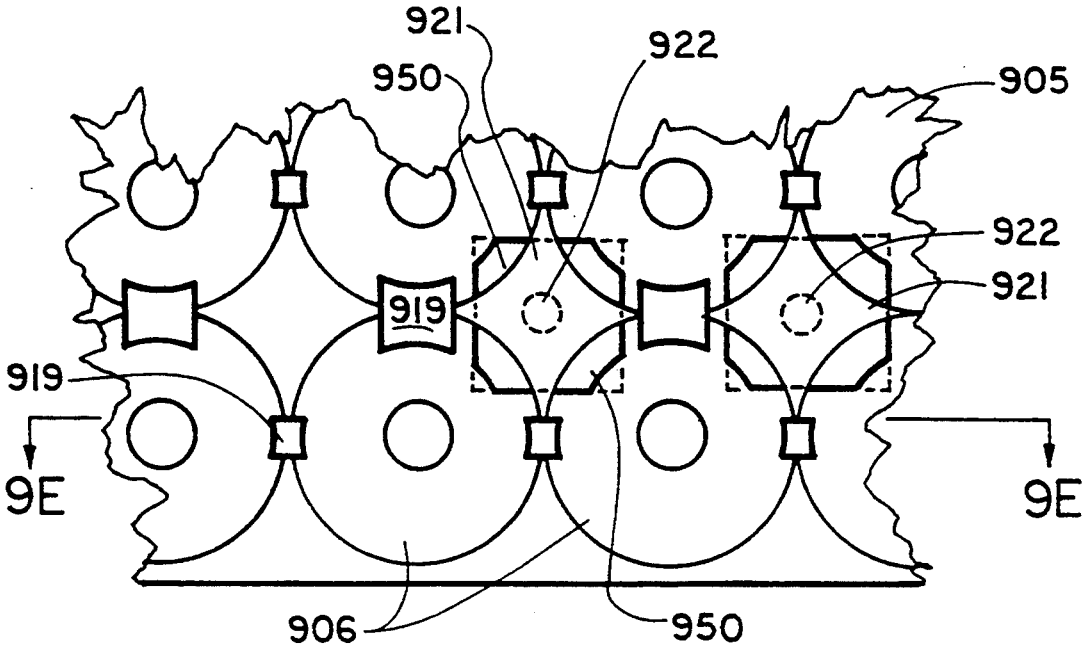
FIG. 9D is a top view of a portion of the spacer 905 of FIG. 9A.
Figure 9E:
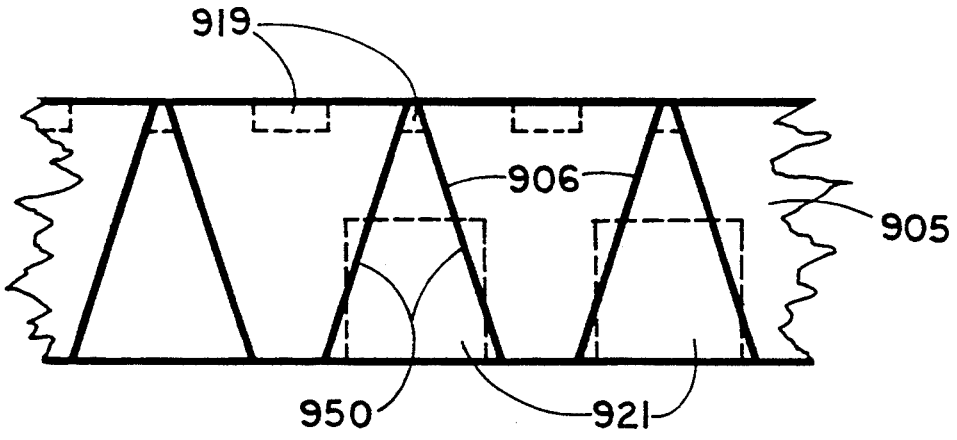
FIG. 9E is a cross-sectional view of the spacer of FIG. 9D taken along the line 9E—9E in FIG. 9D.

The construction of through holes 921, 922 is illustrated in more detail by reference to FIGS. 9D, 9E. FIG. 9D is a top view of a portion of the spacer 905 of FIG. 9A. FIG. 9E is a cross-sectional view of the spacer of FIG. 9D taken along the line 9E—9E in FIG. 9D. As shown in FIGS. 9D, 9E, the two holes 921 intersect channels 906 at openings 950, so that channels 906 are in communication with holes 922 through openings 950 and holes 921. In this manner, the air in all of the channels 906 may be evacuated through conduits or grooves 919, openings 950 and holes 922, 921 and outlets 918 shown in FIG. 9A.

Since the above described structure is targeted for low resolution with dot pitch between 0.5 mm to 6 mm range, even with all the above details the spacer plate is still relatively easy to manufacture in low cost and at high volume. Thus the device described above in reference to FIGS. 9A–9C may be used as one of many mosaic tiles in a large screen mosaic display. The mosaic tile in this embodiment will exhibit very uniform sidewall. The pixel pitch can be arranged in such a way, that when they are assembled together to form a large screen, essentially no visible gap line between each tile can be observed within proper viewing distance.

Figure 10:
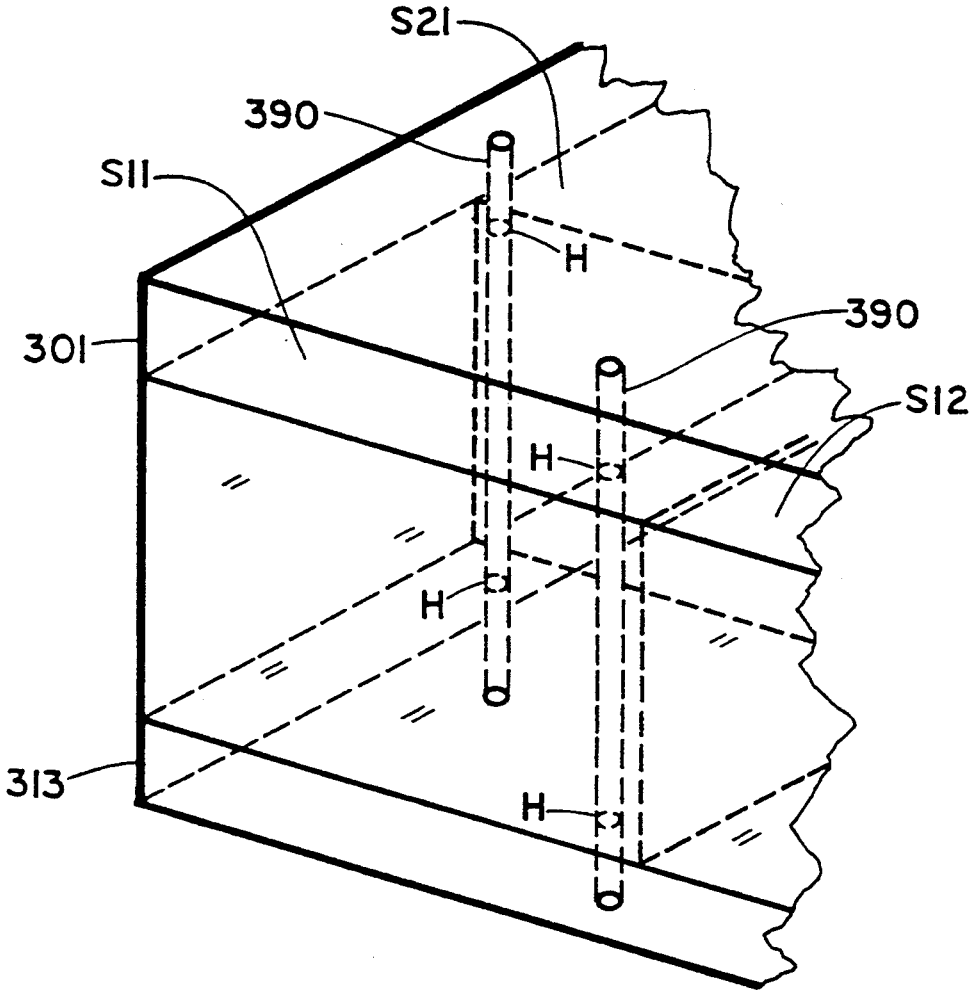
FIG. 10 is a perspective view of a portion of a display device illustrating the multiple piece spacer structure.

For a single piece large screen display device in the size between 20" to 50" diagonally across, the present invention can also be applied. The face plate can be a homogeneous transparent glass plate with thickness between 1.5 mm to 5 mm. The composite spacer plate, or spacer plate in the single piece structure can be composed of multiple pieces and aligned through alignment holes provided on the peripheral space as shown in FIG. 10. FIG. 10 is a perspective view of a portion of a display device illustrating the multiple piece spacer structure. Three single layer spacer plates S11, S12, D21 of an array of spacer plates are shown in FIG. 10. As also shown in FIG. 10, each spacer plate such as S11 is aligned with the face and back plates 301, 313 by means of alignment pins 390. Pins 390 intersect and enter spacer S11 at holes H as shown. For simplicity, only two alignment pins are shown, it being understood that three alignment pins are needed to align each of the spacer plates in the spacer plate array with the face and back plates. The relative positions of the spacer array with respect to the anode and cathode groups can be further secured through the use of adhesive means. The cathode can also be composed by assembling smaller piece of field emission cathode group array on top of a homogeneous glass back plate with known technology commonly used in the IC and thick film industry as shown and described above by reference to FIGS. 3H, 3I.

Figure 11:
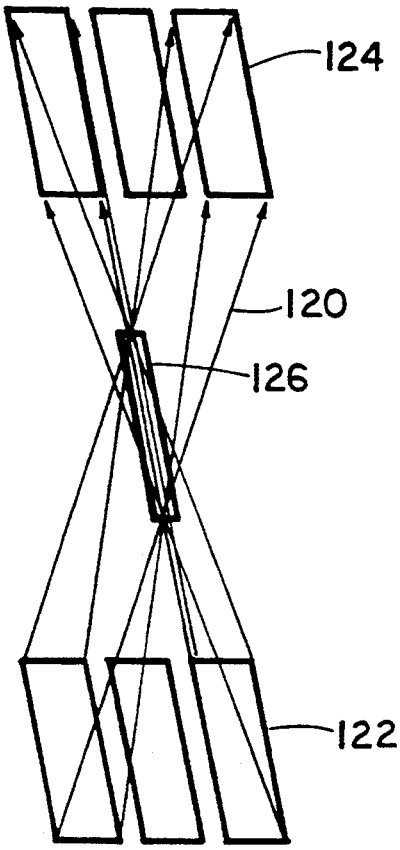
FIG. 11 is a schematic perspective view of a display device to illustrate concept of the invention.

In the embodiments described above in reference to FIGS. 1–8, the apertures or pin holes are formed in spacers also used to support the face and back plate against pressure originating from outside the housing of the display device. It will be understood, however, that the aperture or pin hole may be formed in a manner different from that described above, using mechanical or other means. This is illustrated in FIG. 11. The arrows 120 represent the paths of electrons passing between the three groups of cathodes 122 and the three pixel dots 124 in a manner similar to that described above in reference to FIG. 2, except that the paths 120 are not necessarily confined to funnel-shaped channels as in FIG. 2. The paths of these electrons are restricted by the size of the aperture which is in the shape of an elongated slit 126. As long as the paths 120 of the electrons are restricted to those passing through the slit 126, the above-described advantages of the invention, such as crosstalk reduction, would be available. Apertures in shapes other than slits are, of course, also possible and are within the scope of the invention.

Figure 12:
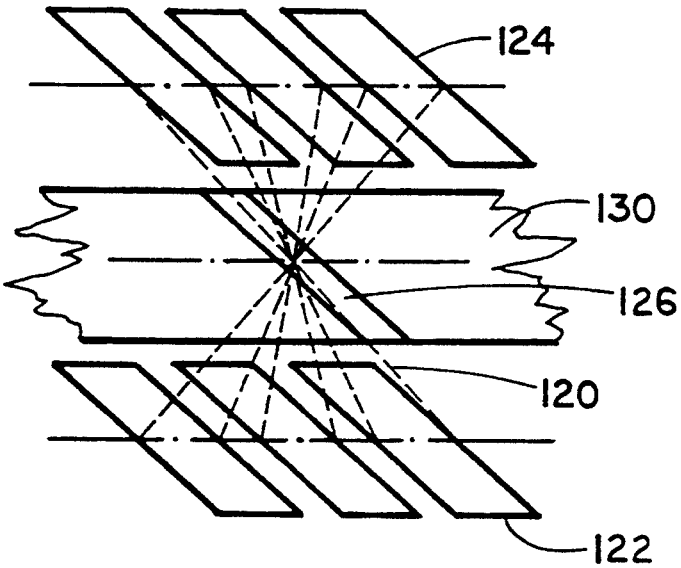
FIG. 12 is a simplified schematic view of a display device where the aperture for passage of electrons is formed in a plate to illustrate one implementation of the concept of FIG. 11.

FIG. 12 illustrates one mechanical means other than a spacer in which the aperture is defined for implementing the concept of FIG. 11. As shown in FIG. 12, aperture or slit 126 is formed in a shielding plate 130. Different from the spacers described above, shielding plate 130 does not need to contact or support the face and back plates.

Figure 13A:
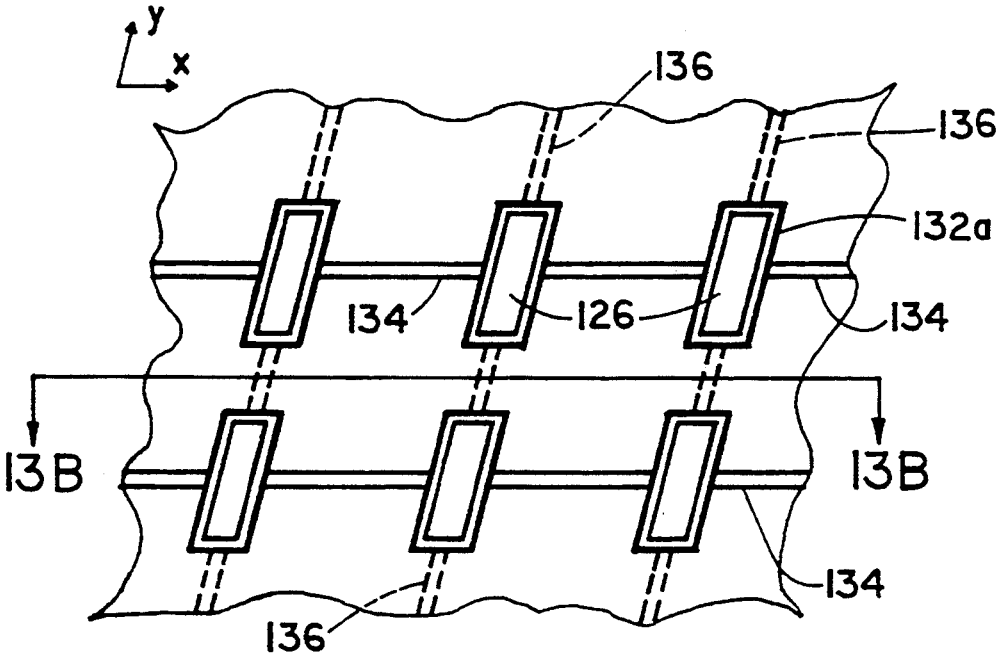
FIG. 13A is a perspective view of a portion of a shielding plate with lens electrodes to illustrate the invention.

FIG. 13A is a perspective view from the top of a portion of the shielding plate to illustrate the invention. As shown in FIG. 13A, lens electrodes 132*a* are formed on a top surface of the shielding plate (and lens electrodes 132*b* on a bottom surface of the shielding plate as shown more clearly in FIG. 13B) surrounding apertures 126. As discussed above, electrical potentials may be applied to the lens electrodes in order to focus the paths of the electrons or to turn off the stream of electrons through the apertures for the purpose of direct matrix addressing.

Figure 13B:
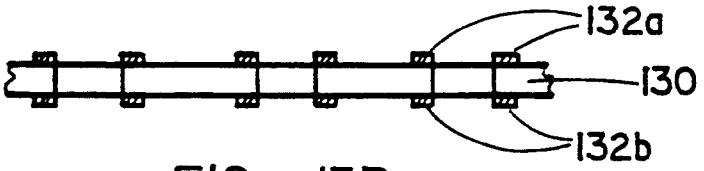
FIG. 13B is a cross-sectional view of the shielding plate of FIG. 13A taken along the line 13B—13B in FIG. 13A.
Figure 13C:
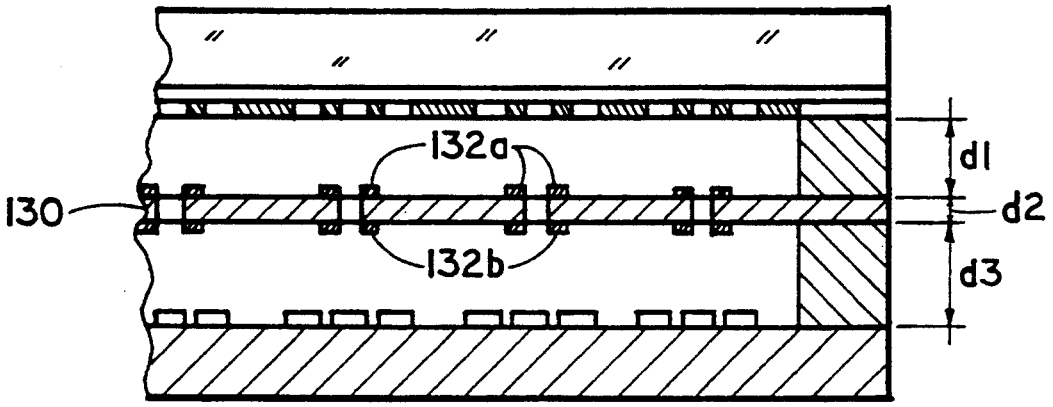
FIG. 13C is a cross-sectional view of a portion of a display device employing the shielding plate of FIGS. 13A, 13B.

FIG. 13B is a cross-sectional view of the shielding plate of FIG. 13A along the line 13B—13B to illustrate one embodiment of a lens electrode arrangement on the shielding plate. As shown in FIG. 13B, lens electrodes 132*a*, 132*b* are present on both sides of the shielding plate 130. FIG. 13C is a cross-sectional view of a portion of a display device employing the shielding plate and the lens electrode configuration of FIGS. 13A, 13B.

As shown in FIGS. 13A, the lens electrodes 132*a* on the top surface of the shielding plate are connected to a power supply (not shown) through electrically conductive traces 134 for row or x-direction addressing, and the lens electrodes 132*b* (not visible in FIG. 13A) are connected by conductive traces 136 to a power supply (not shown) for column or y-direction addressing. In this manner, the two sets of lens electrodes permit xy addressing. It is only when the potentials at lens electrodes 132*a*, 132*b* at a particular aperture 126 are both more positive than the corresponding cathode group will electrons emitted by the group pass through the particular aperture 126 to reach the corresponding pixel dot for displaying an image. Therefore, if this is true (both lens electrodes more positive than corresponding cathode group) at one particular aperture and not true at adjacent or surrounding apertures, electrons will pass only through such particular aperture and not through the adjacent apertures. This will reduce crosstalk. For this reason, it is desirable to provide indepedently addressable lens electrodes on both sides of the shielding plate.

Figure 14A:
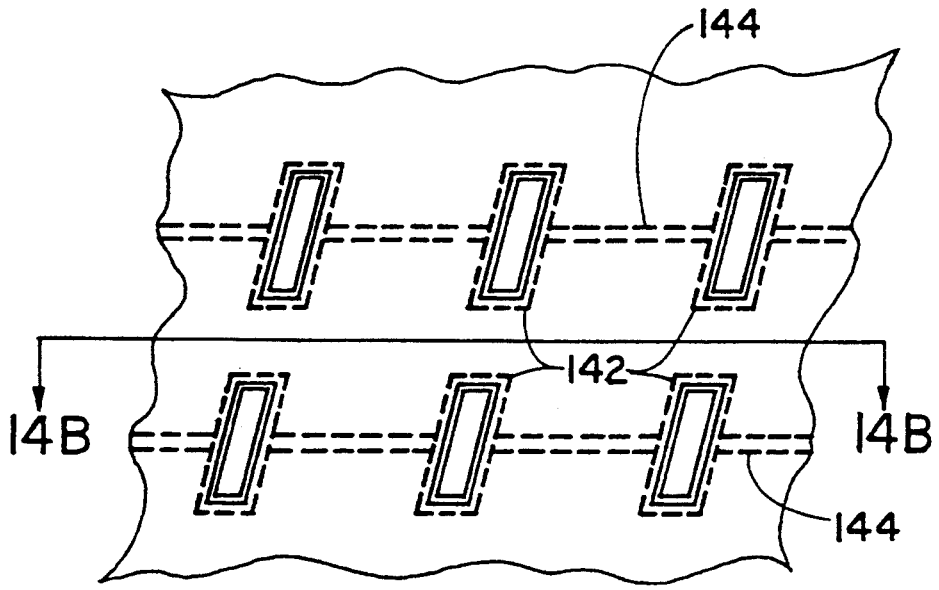
FIG. 14A is a perspective view of a portion of a shielding plate with different arrangement of lens electrodes from FIG. 13A to illustrate the invention.
Figure 14B:
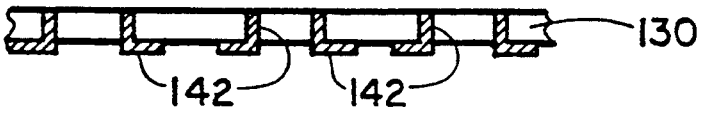
FIG. 14B is a cross-sectional view of the shielding plate of FIG. 14A taken along the line 14B—14B.
Figure 14C:
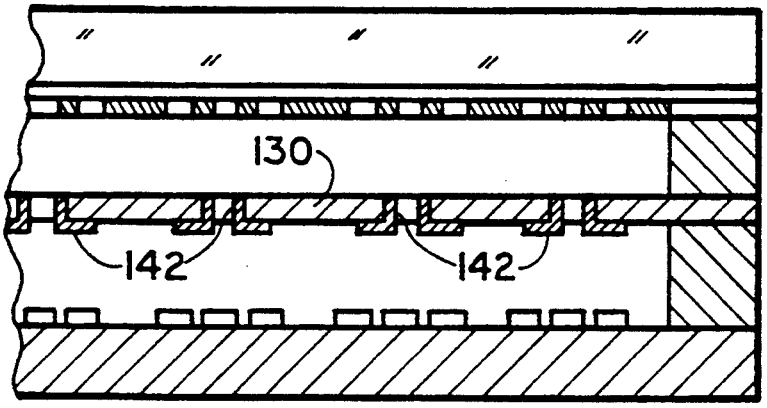
FIG. 14C is a cross-sectional view of a portion of a display device employing the shielding plate of FIGS. 14A, 14B.

FIG. 14A is a perspective view from the top of a portion of shielding plate and lens electrode to illustrate another embodiment. FIG. 14B is a cross-sectional view of the shielding plate of FIG. 14A taken along the line 14B—14B in FIG. 14A. As shown in FIG. 14A, 14B, the lens electrodes 142 are present on the bottom surface but not the top surface of the shielding plate 130, and the lens electrodes on the bottom surface extend onto the surfaces of the apertures as shown in FIG. 14B. The lens electrodes are connected by conductive traces 144 for addressing purposes as in FIG. 13A. It is of course possible to coat just the inside surfaces of the aperture without coating the top or bottom surface of the shielding plate to form the lens electrodes. FIG. 14C is a cross-sectional view of a portion of a display device employing the shielding plate of FIGS. 14A, 14B.

Figure 15:
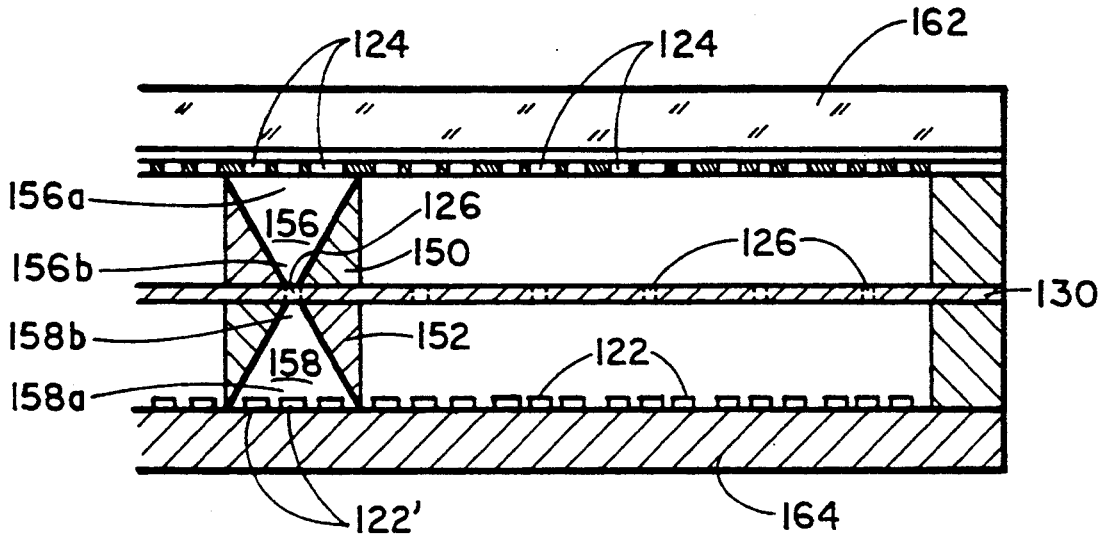
FIG. 15 is a cross-sectional view of a portion of a display device employing a shielding plate together with two spacers, each with one funnel-shaped channel therein.

FIG. 15 is a cross-sectional view of a portion of a display device employing a shielding plate 130 with or without lens electrodes and two spacers 150, 152. As shown in FIG. 15, each of the two spacers defines a funnel-shaped channel 156, 158 therein, where the wide ends 156*a*, 158*a* of the channels are at or adjacent to the face plate 162 or back plate 164 and their narrow ends 156*b*, 158*b* at or adjacent to the shielding plate 130. The narrow ends of the two channels of the two spacers 150, 152 are aligned with an aperture 126, so that electrons originating from groups of cathodes 122′ facing the channels may pass through aperture 126 as well as the channels to the pixel dots 124, while electrons originating from groups of cathodes 122 not facing the channels may pass through apertures 126 and are not confined by the channels in spacers 150, 152. Thus, channels 156, 158 being aligned with aperture 126, form a pair of aligned channels. As shown in FIG. 15, spacers 150, 152 together have only one pair of aligned channels.

Figure 16:
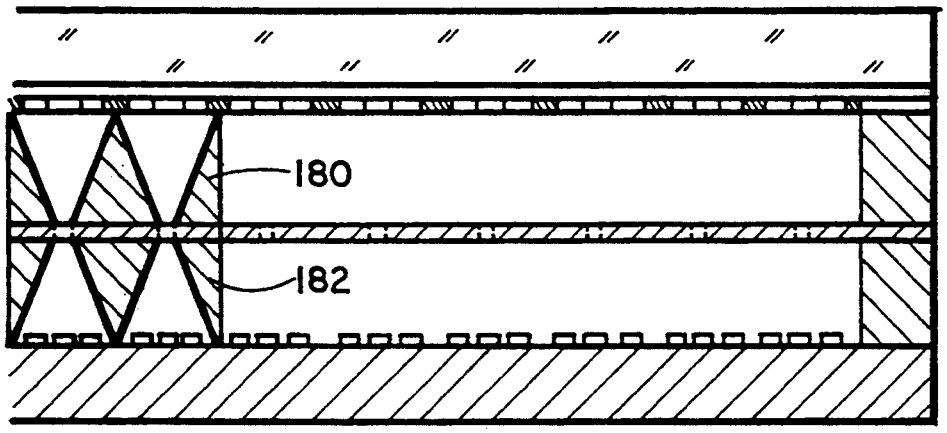
FIG. 16 is a cross-sectional view of a portion of a display device employing a shielding plate and two spacers each with two funnel-shaped channels therein.

FIG. 16 is a cross-sectional view of a portion of a display device employing a shielding plate 130 and two spacers 180, 182, each with two funnel-shaped channels therein. Thus, spacers 180, 182 differ from spacers 150, 152 only in that spacers 180, 182 have two pairs of aligned channels instead of one pair.

The invention has been described above by reference to various embodiments. It will be understood that various modifications and changes may be made without departing from the scope of the invention which is to be limited only by the appended claims.

What is claimed is:

1. A display apparatus comprising:

a housing defining a chamber therein, said housing having a face plate and a back plate;

an anode placed on or near the face plate;

luminescent means, placed on or near the anode, that emits light in response to bombardment of electrons, said luminescent means having two portions defining at least a first and a second pixel dot;

a plurality of individually addressable, controllable electron point source cathodes arranged in at least a first and a second group on or near the back plate;

a circuit for applying electrical potentials to the anode and groups of cathodes for causing the cathodes to emit electrons and causing the electrons to travel to the pixel dots, and direct matrix addressing and electron emission control of the cathodes;

a shield between the face and back plates, said shield defining at least one aperture therein located between the groups of cathodes and the pixel dots, said shield substantially shielding the pixel dots from electrons passing between the cathodes and pixel dots except for electrons passing through said aperture, wherein said aperture is of such dimensions that electrons emitted by cathodes in said at least first and second groups and spread over an area larger than said dimensions will converge and pass through the aperture and then diverge towards the pixel dots, and that electrons emitted by the first group of cathodes and passing through the aperture will travel to substantially only the first pixel dot, and that electrons emitted by the second group of cathodes and passing through the aperture will travel to substantially only the second pixel dot, thereby reducing crosstalk between pixel dots.

2. The apparatus of claim 1, and luminescent means defining an array of clusters of pixel dots, each cluster including at least two pixel dots, said cathodes arranged in an array of clusters of groups, wherein said shield defines therein an array of apertures, each aperture located between a cluster of pixel dots and a cluster of groups of cathodes where such aperture, cluster of pixel dots and cluster of groups of cathodes define a set of corresponding aperture, cluster of pixel dots and cluster of groups of cathodes, wherein each cluster occupies an area larger than the corresponding aperture and supplies electrons that converge and pass through the corresponding aperture and then diverge and are destined for corresponding pixel dots in the corresponding cluster.

3. The apparatus of claim 2, wherein each of the corresponding aperture, cluster of pixel dots and cluster of groups of cathodes in a set is an element of the set, wherein at least two elements of at least one set of corresponding aperture, cluster of pixel dots and cluster of groups of cathodes have similar geometrical shapes.

4. The apparatus of claim 2, wherein the number of clusters of pixel dots is the same as the number of clusters of groups of cathodes in each of at least some of the sets of corresponding aperture, cluster of pixel dots and cluster of groups of cathodes.

5. The apparatus of claim 2, wherein the shield includes at least one spacer plate between the face and back plates.

6. The apparatus of claim 5, said at least one spacer plate located between and in contact with the face and back plates, said spacer plate having an array of channels therein between the face and back plates, each channel having a narrowest portion defining one of said apertures, each channel permitting electrons to pass between a cluster of groups of cathodes and its corresponding cluster of pixel dots through its corresponding aperture.

7. The apparatus of claim 6, said shield having one or more conduits therein connecting substantially all of the channels, to facilitate the evacuation of the channels.

8. The apparatus of claim 6, said shield having channel surfaces that are electrically resistive to reduce electron build up on said surfaces.

9. The apparatus of claim 6, said face and back plates defining grooves therein connecting substantially all of the channels, to facilitate the evacuation of the channels.

10. The apparatus of claim 6, each of said channels being narrowest at said corresponding aperture and said channel increasing in its cross-sectional dimensions from the aperture towards the face and back plates.

11. The apparatus of claim 6, wherein the spacer plate has channel surfaces that are light reflective to reflect towards the face plate light travelling towards the channel surfaces away from the face plate to increase brightness and efficiency of the apparatus.

12. The apparatus of claim 6, said shield including two spacer plates in contact with each other and located between the face and back plates, each spacer plate having an array of funnel-shaped channels therein, each channel of each plate having a wide end at the face or back plate and a narrow end adjacent to and in communication with the narrow end of a corresponding channel of the other spacer plate, wherein the adjacent narrow ends of said two corresponding channels of the two spacer plates define one of said apertures.

13. The apparatus of claim 12, wherein the spacer plate that is closer to the face plate has channel surfaces that are light reflective to reflect towards the face plate light travelling towards the channel surfaces away from the face plate to increase brightness and efficiency of the apparatus.

14. The apparatus of claim 12, wherein the shape of the funnel-shaped channels are such that the wide end of at least one channel in one spacer plate is a mirror image of the wide end of the corresponding channel in the other spacer plate through the aperture formed by the narrow ends of the two corresponding channels.

15. The apparatus of claim 12, wherein each funnel-shaped channel has wedge-shaped walls on four sides to increase the strength of each of the spacer plates.

16. The apparatus of claim 6, further comprising gate and base electrodes responsive to the circuit for controlling the emission of electrons form the cathodes, said shield further comprising lens electrodes located between the gate electrodes and the anode and at or adjacent to the narrow ends of at least some of the channels of one or more spacer plates, said apparatus further comprising a device for applying electrical potentials to said lens electrodes for focusing the electrons passing through said narrow ends of the channels onto desired portions of the luminescent means.

17. The apparatus of claim 6, wherein the channels have substantially rectangular or square cross-sections.

18. The apparatus of claim 6, said apparatus further comprising a black insulating strips separating each two adjacent pixel dots and each two adjacent clusters of pixel dots to increase contrast of display, each channel having a channel wall adjacent to the corresponding cluster of groups of cathodes, wherein each cluster of pixel dots and the channel wall of the channel corresponding to such cluster occupy such areas that black insulating strips adjacent to such cluster of pixel dots form an inverted image of the channel wall of the corresponding channel.

19. The apparatus of claim 1, wherein the shield includes a UV-sensitive glass-ceramic type of material.

20. The apparatus of claim 1, wherein the field emission cathode group is formed of numerous field emission cathodes which can be further grouped to form several sub-groups, said circuit applying electrical potentials to said sub-groups separately and at different times alternately to increase the life time and efficiency of the field emission cathode groups.

21. The apparatus of claim 1, further comprising a plurality of substrates, each supporting one or more groups of the cathodes array.

22. The apparatus of claim 1, the shield comprising many smaller pieces of similar spacer plates arranged in a plane between the face and back plates, said face, back and spacer plates defining alignment holes therein, said apparatus further including alignment pins, said spacer plates assembled through the alignment pins in the alignment holes in the face, back and spacer plates to form a whole shield for the apparatus for use in large screen applications.

23. The apparatus of claim 1, wherein the cathodes include microtip field emission cathodes.

24. The apparatus of claim 1, wherein said shield is made of UV-sensitive glass ceramic type of high resistance material.

25. The apparatus of claim 1, said apparatus further having a side wall, said side wall including a glass plate of thickness between substantially 0.3 to 3 mm, wherein said apparatus is suitable for use in mosaic large screen type displays.

26. The apparatus of claim 1, said housing further comprising:

a side wall connected to the face and back plates to form said housing; and a bonding pattern of conductive material on the inner surface of the side wall connecting said cathodes to connections outside the housing.

27. The apparatus of claim 1, wherein said shield is a spacer in contact with said face and back plates to thereby support the face and back plates against any pressure exerted externally on the plates.

28. The apparatus of claim 1, said shield being a shielding plate interposed between the face and back plates.

29. The apparatus of claim 28, further comprising:

gate and base electrodes on or near the back plate responsive to the circuit for controlling the emission of electrons from the cathodes; and at least one lens electrode located at or near the at least one aperture and on said shielding plate situated between the gate electrodes and the anode, sad circuit applying electrical potentials to said lens electrode for controlling the passage of electrons through said at least one aperture.

30. The apparatus of claim 29, said at least one lens electrode located on one side of said shielding plate.

31. The apparatus of claim 29, said at least one lens electrode located on both sides of said shielding plate.

32. The apparatus of claim 29, said shielding plate having an aperture surface at said at least one aperture, said aperture surface defining said at least one aperture, wherein said at least one lens electrode is located on said aperture surface of said shielding plate.

33. The apparatus of claim 28, further comprising two spacers, one between the face and shielding plates and the other between the shielding and back plates, to provide support to the face and back plates against pressure from outside the housing.

34. The apparatus of claim 33, said two spacers each defines therein a funnel-shaped channel having a wide end at the face and back plates and a narrow end at the shielding plate, the narrow ends of the spacers being aligned with each other and said at least one aperture to permit passage of electrons between the cathodes and the anode through the at least one aperture and the channels in the spacers.

35. The apparatus of claim 34, said two channels in the two spacers with narrow ends of the channels aligned with an aperture defining a pair of aligned channels, said shielding plate defining at least one additional aperture therein, said two spacers defining therein at least one additional pair of aligned channels where the narrow ends of the channels of the additional pair are aligned with said additional aperture.

36. A method for displaying images, said method employing an apparatus comprising: (a) a housing defining a chamber therein, said housing having a face plate and a back plate; (b) an anode placed on or near the face plate; (c) luminescent means, placed on or near the anode, that emits light in response to bombardment of electrons, said luminescent means defining a plurality of pixel dots; (d) a plurality of individually addressable, controllable electron point source cathodes on or near the back plate, each cathode having a gate electrode and a base electrode; (e) a shield between the face and back plates, said shield defining a plurality of apertures therein located between the cathodes ad the pixel dots, and (f) a lens electrode at or near each said apertures located between the gate electrodes and the anode; said method comprising:

applying electrical potentials to the anode, and three groups of electrodes including the lens electrodes, the gate and base electrodes of the cathodes, for causing selected cathodes to emit electrons, said electrical potentials being applied so that the potentials applied to two of the three groups of electrodes are used for scanning and the potentials applied to the remaining one of the three groups of electrodes control the brightness and sharpness of the display.

37. The method of claim 36, said pixel dots arranged in an array of clusters of pixel dots, and said cathodes arranged in an array of clusters of groups of cathodes, said shield substantially shielding a cluster of pixel dots from electrons passing between the cathodes and pixel dots except for electrons passing through an array of apertures, each aperture located between a cluster of pixel dots and a cluster of groups of cathodes where such aperture, cluster of pixel dots and cluster of groups of cathodes define corresponding aperture, cluster of pixel dots and cluster of groups of cathodes; wherein each aperture is of such dimensions that electrons emitted by a first group of cathodes in the corresponding cluster and passing through the aperture will travel to substantially only a first pixel dot, and that electrons emitted by the second group of cathodes and passing through the aperture will travel to substantially only the second pixel dot;

wherein the electrical potentials applied to the lens electrodes at or near the apertures are such that overlapping of images at the luminescent means is reduced.

38. The method of claim 37, wherein the electrical potentials applied to the lens electrodes at or near the apertures are between the electrical potentials applied to the anode and those applied to the gate and base electrodes of the corresponding clusters of groups of cathodes of the apertures.

39. The method of claim 36, wherein the electrical potentials applied to the lens electrodes at or near some of the apertures are different from the electrical potentials applied to the lens electrodes at or near other apertures, thereby producing different multiple shades of images displayed.

40. A display apparatus comprising:

a housing defining a chamber therein, said housing having a face plate and a back plate;

an anode placed on or near the face plate;

luminescent means, placed on or near the anode, that emits light in response to bombardment of electrons, said cathodoluminescent means defining an array of pixel dots;

a plurality of individually addressable, controllable electron point source cathodes arranged in an array of groups of said cathodes on or near the back plate;

a circuit for applying electrical potentials to the anode and groups of cathodes for causing the cathodes to emit electrons and causing the electrons to travel to the pixel dots, and direct matrix addressing and electron emission control of the cathodes;

a spacer between the face and back plates, said spacer defining an array of funnel-shaped channels, each channel located between a pixel dot and a group of cathodes, each of said channels having a wide end at or near the back plate and a narrow end that extends away from the wide end at or near the back plate towards the anode, said narrow end forming an aperture, where such aperture, pixel dot and group of cathodes define corresponding channel, pixel dot and group of cathodes, wherein each channel permits passage of electrons through its aperture from the corresponding group of cathodes to the corresponding pixel dot.

41. The apparatus of claim 40, said spacer having one or more conduits therein connecting substantially all of the channels, to facilitate the evacuation of the channels.

42. The apparatus of claim 40, said spacer having channel surfaces that are electrically resistive to reduce electron build up on said surfaces.

43. The apparatus of claim 40, said face and back plates defining grooves therein connecting substantially all of the channels, to facilitate the evacuation of the channels.

44. The apparatus of claim 43, wherein the spacer has channel surfaces that are light reflective to reflect towards the face plate light travelling towards the channel surfaces away from the face plate to increase brightness and efficiency of the apparatus.

45. The apparatus of claim 40, wherein each funnel-shaped channel has wedge-shaped walls on four sides to increase the strength of each of the spacer plates, said spacer plates being in contact with the face or back plates over the surfaces of the spacer plates except for the channels.

46. The apparatus of claim 40, wherein the channels have substantially rectangular or square cross-sections.

47. The apparatus of claim 40, wherein the spacer includes a UV-sensitive glass-ceramic type of material.

48. The apparatus of claim 40, said apparatus further comprising a black insulating strips separating each two adjacent pixel dots to increase contrast of display.

49. The apparatus of claim 40, wherein the field emission cathode groups are each divided into several sub-groups, said circuit applying electrical potentials to said sub-groups separately and at different times alternately to increase the life time and efficiency of the field emission cathode groups.

50. The apparatus of claim 40, further comprising a plurality of substrates, each supporting one or more groups of the cathodes array.

51. The apparatus of claim 40, the spacer comprising many smaller pieces of similar spacer plates arranged in a plane between the face and back plates, said face, back and spacer plates defining alignment holes therein, said apparatus further including alignment pins, said spacer plates assembled through the alignment pins in the alignment holes in the face, back and spacer plates to form a whole spacer for the apparatus for use in large screen applications.

52. The apparatus of claim 40, wherein the cathodes include microtip field emission cathodes.

53. The apparatus of claim 40, wherein the spacer is made of UV-sensitive glass ceramic type of high resistance material in white color.

54. The apparatus of claim 40, said apparatus further having a side wall, said side wall including a glass plate of thickness between substantially 0.3 to 3 mm, wherein said apparatus is suitable for use in mosaic large screen type displays.

55. The apparatus of claim 40, said housing further comprising:

a side wall connected to the face and back plates to form said housing; and a bonding pattern of conductive material on the inner surface of the side wall connecting said cathodes to connections outside the housing.

56. The apparatus of claim 40, wherein said spacer is in contact with said face and back plates to thereby support the face and back plates against any pressure exerted externally on the plates.

* * * * *